US009937985B2

(12) United States Patent
Arditi

(10) Patent No.: US 9,937,985 B2
(45) Date of Patent: Apr. 10, 2018

(54) SYSTEM AND METHOD FOR PLANNING AND PREDETERMINATION OF FENDER HEIGHTS AND DOCK LOCATION INFORMATION

(71) Applicant: Shmuel Sam Arditi, Discovery Bay, CA (US)

(72) Inventor: Shmuel Sam Arditi, Discovery Bay, CA (US)

( * ) Notice: Subject to any disclaimer, the term of this patent is extended or adjusted under 35 U.S.C. 154(b) by 0 days.

(21) Appl. No.: 15/362,785

(22) Filed: Nov. 28, 2016

(65) Prior Publication Data

US 2017/0066512 A1 Mar. 9, 2017

Related U.S. Application Data

(63) Continuation-in-part of application No. 15/237,603, filed on Aug. 15, 2016, which is a continuation-in-part of application No. 15/178,515, filed on Jun. 9, 2016, and a continuation-in-part of application No. 15/054,125, filed on Feb. 25, 2016, now Pat. No. 9,409,637, and a continuation-in-part of application No. 14/981,858, filed on Dec. 28, 2015, now Pat. No. 9,598,157, which is a continuation-in-part of application No. 14/929,369, filed on Nov. 1, 2015, now Pat. No. 9,440,716.

(60) Provisional application No. 62/373,333, filed on Aug. 10, 2016, provisional application No. 62/360,966, filed on Jul. 12, 2016, provisional application No. 62/153,193, filed on Apr. 27, 2015, provisional application No. 62/148,725, filed on Apr. 16, 2015, provisional application No. 62/153,185, filed on Apr. 27, 2015, provisional application No. 62/157,857, filed on May 6, 2015, provisional application No. 62/165,798, filed on May 22, 2015, provisional application No. 62/200,089, filed on Aug. 2, 2015.

(51) Int. Cl.
*B63B 59/02* (2006.01)

(52) U.S. Cl.
CPC ..... *B63B 59/02* (2013.01)

(58) Field of Classification Search
CPC ..... B63B 59/02; B63B 25/00; B63B 59/00; B63B 19/00; B63B 19/02; B63B 19/09; E21B 15/02
USPC ..... 114/219; 701/208, 209, 211, 212
See application file for complete search history.

(56) References Cited

U.S. PATENT DOCUMENTS 1,505,785 A 8/1924 Jiengiel
4,817,552 A 4/1989 Poldervaart
(Continued)

FOREIGN PATENT DOCUMENTS

EP 1277651 A1 1/2003
SU 882828 A1 11/1981
(Continued)

*Primary Examiner* — Lars A Olson
(74) *Attorney, Agent, or Firm* — Galvin Patent Law LLC; Brian R. Galvin

(57) ABSTRACT

A system for planning and predetermination of boat fender heights and dock location information, comprising a boat fender controller configured to calculate a required fender deployment height prior to arrival at a predetermined dock location, based on real-time information, and to raise or lower a plurality of boat fenders based on the calculated fender deployment height on final approach to the predetermined dock location.

20 Claims, 34 Drawing Sheets

(56) References Cited

U.S. PATENT DOCUMENTS

| | | | | |
|---|---|---|---|---|
| 6,216,789 | B1 * | 4/2001 | Lorsignol | B66D 1/505 166/355 |
| 6,758,155 | B1 * | 7/2004 | Nicholas | B63B 59/02 114/219 |
| 7,007,622 | B1 | 3/2006 | Clark | |
| 7,775,176 | B2 | 8/2010 | Abel | |
| 8,136,467 | B2 | 3/2012 | Powell et al. | |
| 9,038,556 | B2 | 5/2015 | Ulgen | |
| 9,409,637 | B1 | 8/2016 | Arditi | |

FOREIGN PATENT DOCUMENTS

| | | | |
|---|---|---|---|
| WO | 2007083997 | A1 | 7/2007 |
| WO | 2014007614 | A1 | 1/2014 |

* cited by examiner

400

1900

1901a, b

2300

SYSTEM AND METHOD FOR PLANNING AND PREDETERMINATION OF FENDER HEIGHTS AND DOCK LOCATION INFORMATION

CROSS-REFERENCE TO RELATED APPLICATIONS

This application claims the benefit of, and priority to, U.S. provisional patent application Ser. No. 62/373,333 titled, "SYSTEM AND METHOD FOR TRIP PLANNING AND PREDETERMINATION OF FENDER HEIGHTS AND DOCK LOCATION INFORMATION" filed on Aug. 10, 2016, and is also a continuation-in-part of U.S. patent application Ser. No. 15/237,603, titled "ENHANCED SYSTEM AND METHOD FOR CONTROLLING AUTOMATIC DEPLOYMENT OF BOARD FENDERS", filed on Aug. 15, 2016, which claims priority to U.S. provisional patent application Ser. No. 62/360,966, titled "ENHANCED SYSTEM AND METHOD FOR CONTROLLING AUTOMATIC DEPLOYMENT OF BOAT FENDERS," filed on Jul. 12, 2016, and is also a continuation-in-part of U.S. patent application Ser. No. 15/178,515, titled "ENHANCED SYSTEM AND METHOD FOR DEPLOYING BOAT FENDERS SAFELY AND CONVENIENTLY", filed on Jun. 9, 2016, which is a continuation-in-part of U.S. patent application Ser. No. 15/054,125, titled ENHANCED SYSTEM AND METHOD FOR REMOTELY DEPLOYING BOAT FENDERS, filed on Feb. 25, 2016, now issued as U.S. Pat. No. 9,409,637 on Aug. 9, 2016, which is a continuation-in-part of U.S. patent application Ser. No. 14/981,858 titled "ENHANCED SYSTEM AND METHOD FOR DETANGLING AND PROTECTION OF AUTOMATIC FENDER POSITIONING SYSTEMS", filed on Dec. 28, 2015, which is a continuation-in-part of U.S. patent application Ser. No. 14/929,369, titled "ENHANCED SYSTEM AND METHOD FOR AUTOMATICALLY DEPLOYING BOAT FENDERS", filed on Nov. 1, 2015, which claims priority to U.S. provisional patent application Ser. No. 62/153,193, titled "ENHANCED SYSTEM AND METHOD FOR AUTOMATICALLY DEPLOYING BOAT FENDERS", filed on Apr. 27, 2015, and to U.S. provisional patent application Ser. No. 62/148,725, titled "SYSTEM AND METHOD FOR SAFELY AND CONVENIENTLY DEPLOYING BOAT FENDERS", filed on Apr. 16, 2015, and to U.S. provisional patent application Ser. No. 62/153,185, titled "ENHANCED SYSTEM AND METHOD FOR AUTOMATICALLY DEPLOYING BOAT FENDERS 2", filed on Apr. 27, 2015, and to U.S. provisional patent application Ser. No. 62/157,857, titled "SYSTEM AND METHOD FOR REDUCING THE PROFILE OF BOAT FENDER BASKETS", filed on May 6, 2015, and to 62/165,798, titled "AUTOMATIC BOAT FENDER BASKETS", filed on May 22, 2015, and to 62/200,089, titled "AUTOMATIC BOAT FENDER LINE GUIDE, CAMERA AND MORE", filed on Aug. 2, 2015. The disclosure of each of the above-referenced patent applications is incorporated herein by reference in its entirety.

BACKGROUND OF THE INVENTION

Field of the Invention

The disclosure relates to the field of boating, and more particularly to the field of deploying protective fenders for use in docking a boat.

Discussion of the State of the Art

Boating, in a motorized or sail-powered craft, is both a popular recreational activity and the foundation of the seafood industry. The operator of the craft must be able to navigate it safely and also to dock it safely; whether at a stationary, land-based dock, next to another boat, or at some other, similar large adjacent object (any and all of which are hereinafter referred to as a "dock"). In cases of stormy weather or large waves, deploying and positioning the protective boat fenders to keep the boat from violently hitting a dock can be tricky and dangerous.

What is needed is a system and method that enables a boat operator to safely and conveniently deploy boat fenders when needed. What is additionally needed is a way to extend and retract boat fenders into and out of protective stowage enclosures from locations remote from the placement of at least some of those fenders, for added safety and convenience. Further needed in other cases is a way to extend and retract boat fenders using a motor-driven mechanism, for even greater added safety and convenience. Additionally needed, in some cases, is a way to extend and retract boat fender baskets beyond a vessel's hull limit or in other cases, to extend and retract fenders through an opening in a boat railing. Further needed is a system and method enabling a user to control these fenders from a mobile computing device, such as a smartphone or tablet. Additionally needed is a system and method to alert the user to deploy the boat's fenders when the boat is on a trajectory that leads to a previously visited dock and, in some cases, to deploy the fenders automatically, all based upon a global positioning system (GPS) location of the boat.

Furthermore, when docking at a slip that is fixed in the ground or attached to a nonmoving structure—that is, a slip that does not float or adjust its height to the water level—a boat still floats at the level of the water. Accordingly, depending on the height of the water, a boat moves up and down the dock's side, and has, therefore, the potential to be damaged.

In the field of the art, improvement is always needed.

SUMMARY OF THE INVENTION

Accordingly, the inventor has conceived and reduced to practice, in a preferred embodiment of the invention, a system and method for planning and predetermination of fender heights which may or may not include dock location information.

According to a preferred embodiment of the invention, a system for planning and predetermination of fender heights and dock location information, comprising a boat fender controller comprising at least a processor and a memory and programmable instructions stored in the memory and operating on a processor, the programmable instructions configured to calculate a required fender deployment height prior to arrival at a predetermined docking location, based on real-time information, the real-time information comprising at least location; and to raise or lower a plurality of boat fenders based on the calculated fender deployment height on final approach to the predetermined docking location, is disclosed.

In one preferred embodiment, a cleat (or auto cleat) allows the line to be secured at any position, the cleat attached to or near the basket, or at a convenient location some distance from the basket. The line may be passing through one or more guide rings or pulleys, and the fender is raised into the basket upon leaving a dock and lowered to the correct level manually in preparation for docking of the boat.

In another preferred embodiment, the fender is attached to the line, the line coupled to a winch, the winch coupled to a motor, and the motor controlled by a controller, wherein the controller is activated via wireline or via wireless control signals such as BLUETOOTH™, ZIGBEE™, or Wi-Fi. Here, the controller may be controlling more than one basket. The winch may draw its power from a battery, where the battery is the onboard power supply or the battery is separate and recharged by a solar panel coupled to the battery. Each basket may have its individual controller, battery and solar panel, as to not require any wiring between the units.

The basket may be mounted with at least one hinge to a stationary part of the boat within the boat's outline, the hinge operable to allow the basket to swing out from the boat's outline, for easy deployment of the fender. Deployment of the basket may be controlled for the swing-out with a lever, the lever attached to stationary part of the boat, the lever may be used to initiate and stop or reverse the swing-out action. The lever may also be a hinged arm and may be operated manually or operated with an additional motor. Deployment of the basket may be controlled for the swing-out by an external force applied to the hinge, which makes the basket swing back into the vessel's outline, counteracting at least one spring connected to the hinge, the spring moving the basket outside the vessel's outline for normal operations. Alternatively the swing-out may be implemented using an additional motor.

Alternately, the basket may be mounted on at least one stationary part of the boat, substantially within the boat's outline, the basket having an angle for enabling the fender to be lowered, either manually or mechanically, through an opening in the railing over the edge of the boat's board and have an additional slide extension at the bottom opening, the extension guiding the fender over the edge of the boat.

According to yet another embodiment of the invention, an application on a smart phone, the application having access to a map system and also optionally having access to a GPS system of the smartphone, wherein the application may be used by a user to add locations used by a vessel for landing, and the user may enter a mark representing a height of fenders to be deployed. The system may then remember the decision of the user whether or not and how to deploy the fenders, or whether no preset action is desired.

In another preferred embodiment, the enclosure may contain a camera looking outward from the boat, the camera supplied power by the same system that operates the fender, and the camera coupled to provide a video stream on request to one of the controlling computing devices, allowing a person to better see when approaching the docking location.

According to yet another embodiment of the invention, a fast cleat may be provided to secure the line in a plurality of positions, one of which has the fender fully retracted and at least one other having the fender deployed, and wherein the fast cleat is mounted in an easy to reach location on the vessel. Where the cleat may be released with a controlled jerking of the line, either by mechanized means or manually.

In a further embodiment, planning and predetermination of fender heights and dock location information is accomplished by collection of data on a server, accessible by network, for boat fender's automated deployment.

BRIEF DESCRIPTION OF THE DRAWING FIGURES

The accompanying drawings illustrate several embodiments of the invention and, together with the description, serve to explain the principles of the invention according to the embodiments. One skilled in the art will recognize that the particular embodiments illustrated in the drawings are merely exemplary, and are not intended to limit the scope of the present invention.

Figure 6:
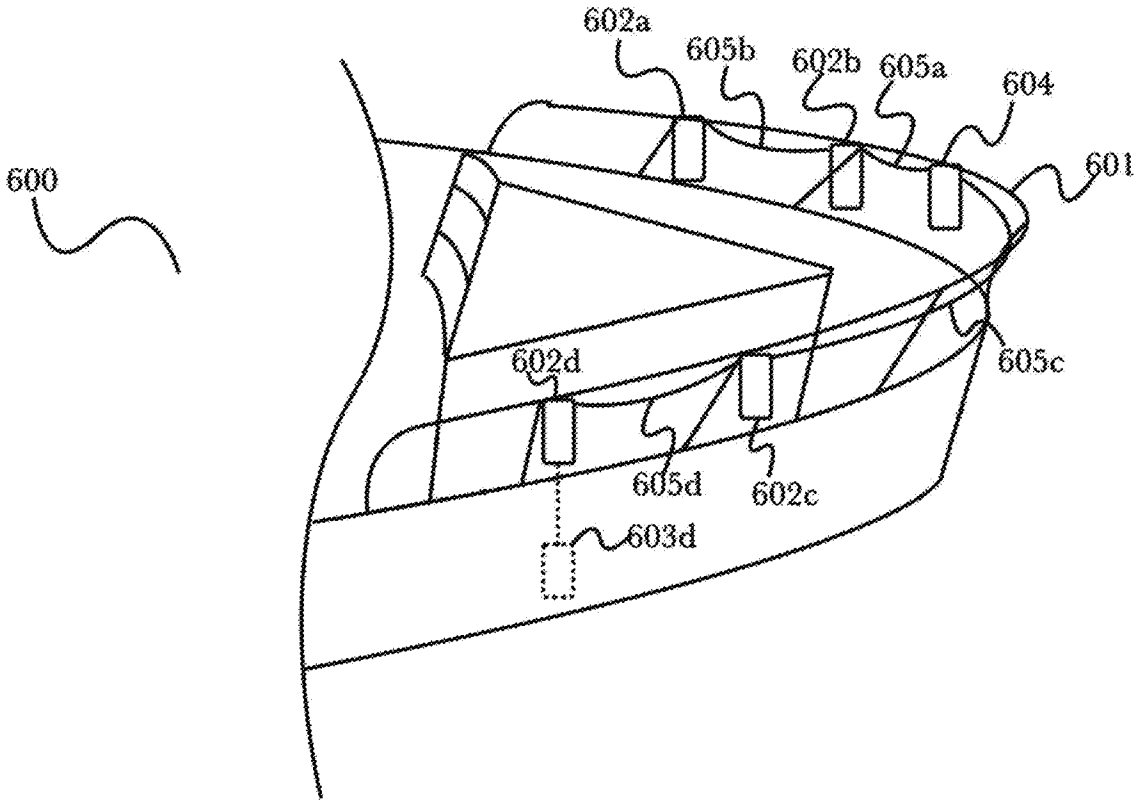

FIG. 6. shows an exemplary representation of the connection of four basket and fender mechanisms connected by wires to a solar panel according to a preferred embodiment of the invention.

Figure 7:
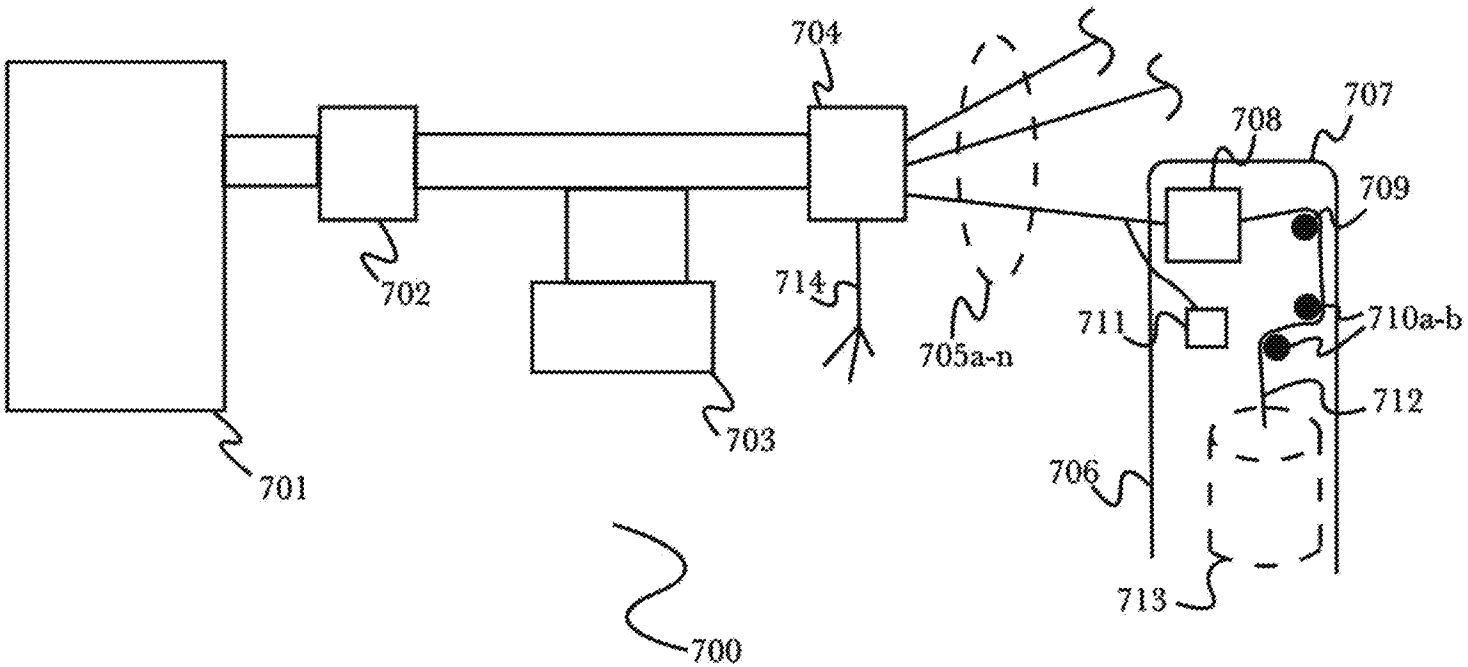

FIG. 7 is a diagram of an exemplary solar panel assembly connected to a basket and fender mechanism according to a preferred embodiment of the invention.

Figure 8:
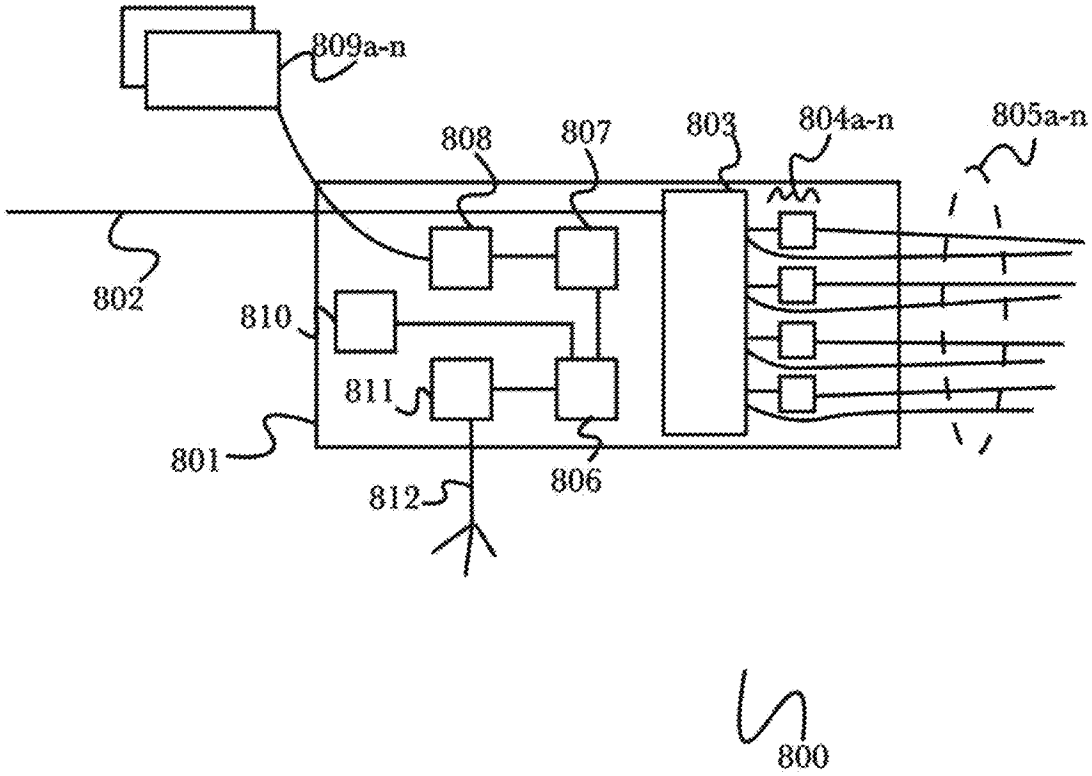

FIG. 8 is a diagram of an exemplary controller for the deployment and retraction of fenders according to a preferred embodiment of the invention.

Figure 9:
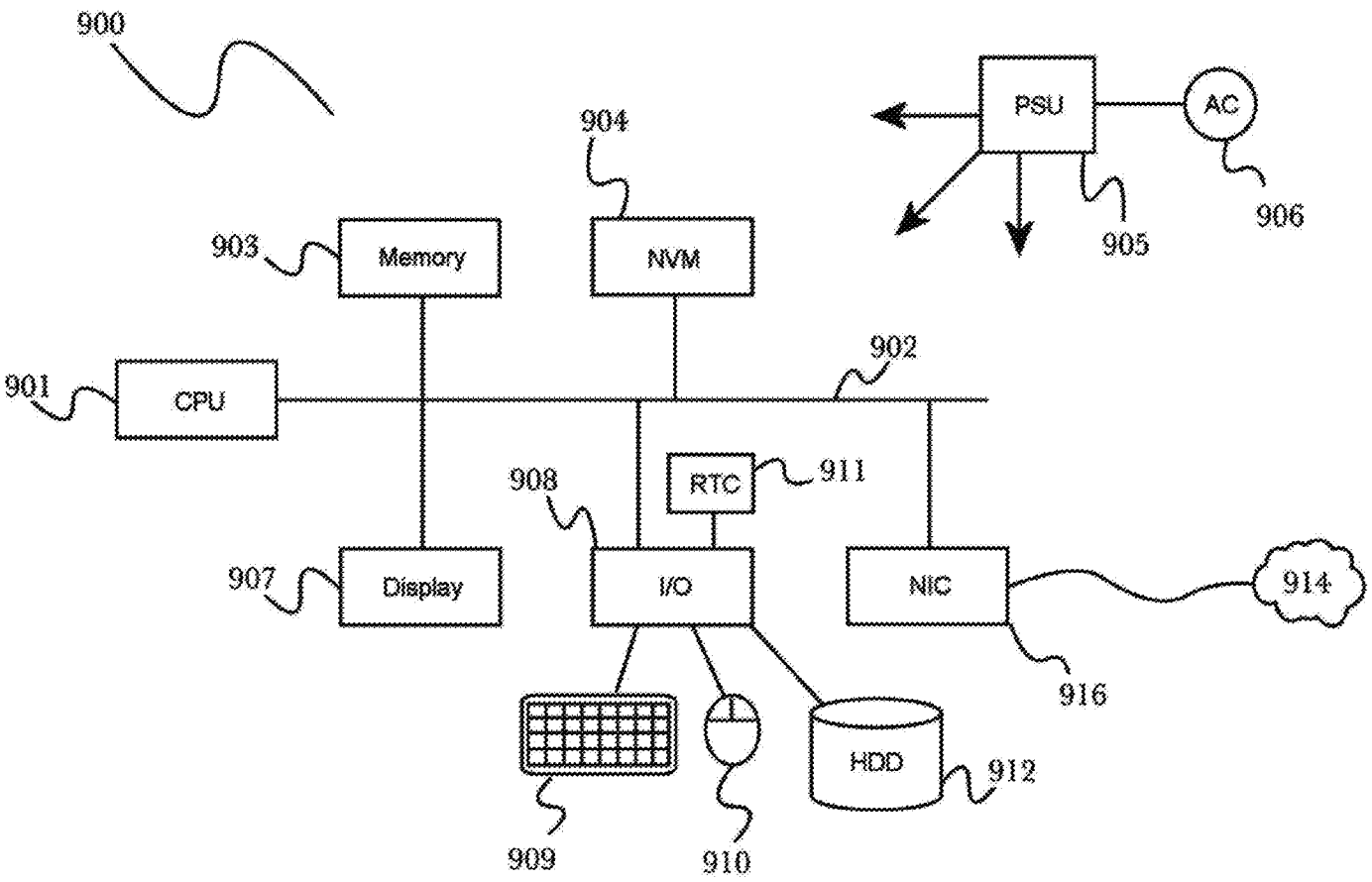

FIG. 9 is an exemplary diagram of a computer system as may be used in the system and methods disclosed herein.

Figure 10:
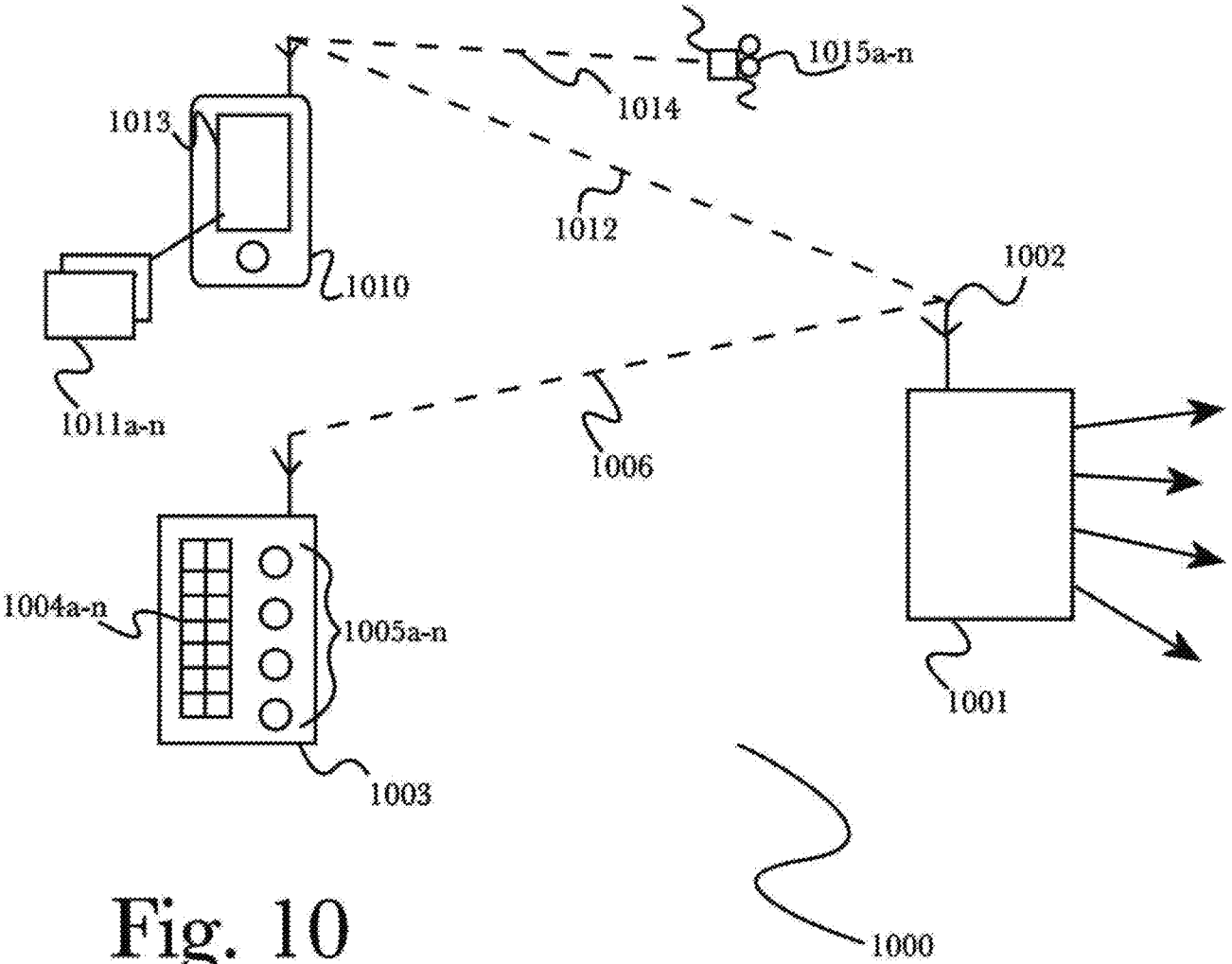

FIG. 10 is an exemplary diagram of a wireless control system for deployment and retraction of boat fenders as per a preferred embodiment of the invention.

Figure 11:
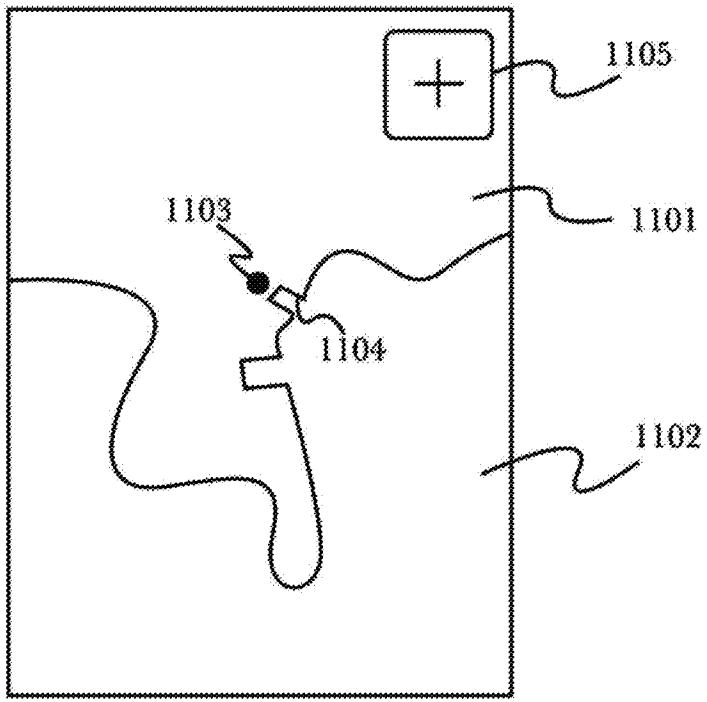
Figure 11:
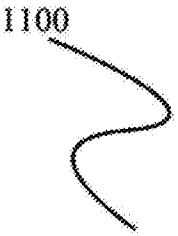

FIG. 11 shows a representation of an exemplary system application screen depicting a boat approaching a dock in a harbor, according to a preferred embodiment of the invention.

Figure 12:
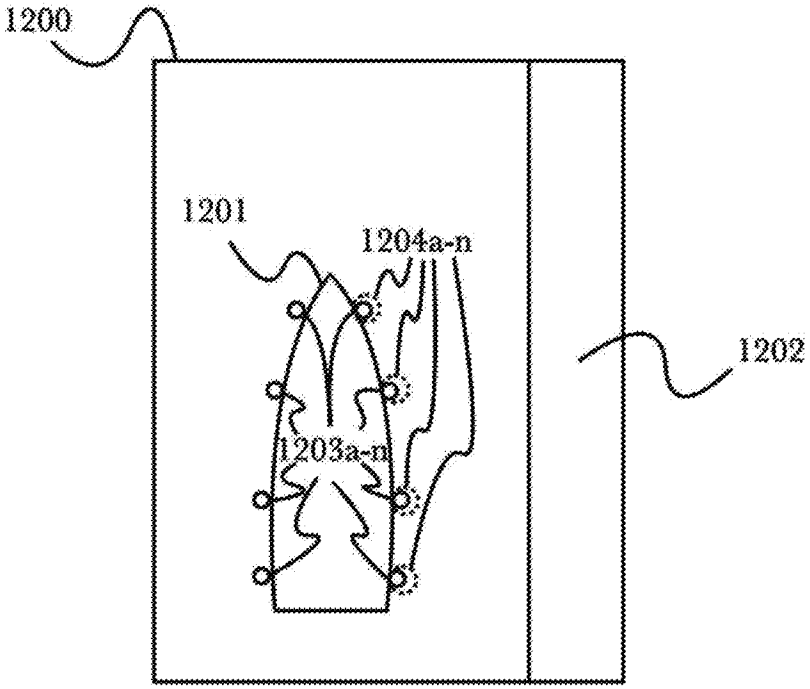

FIG. 12 shows an application screen that is exemplary of additional application functionality according to a preferred embodiment of the invention.

Figure 13:
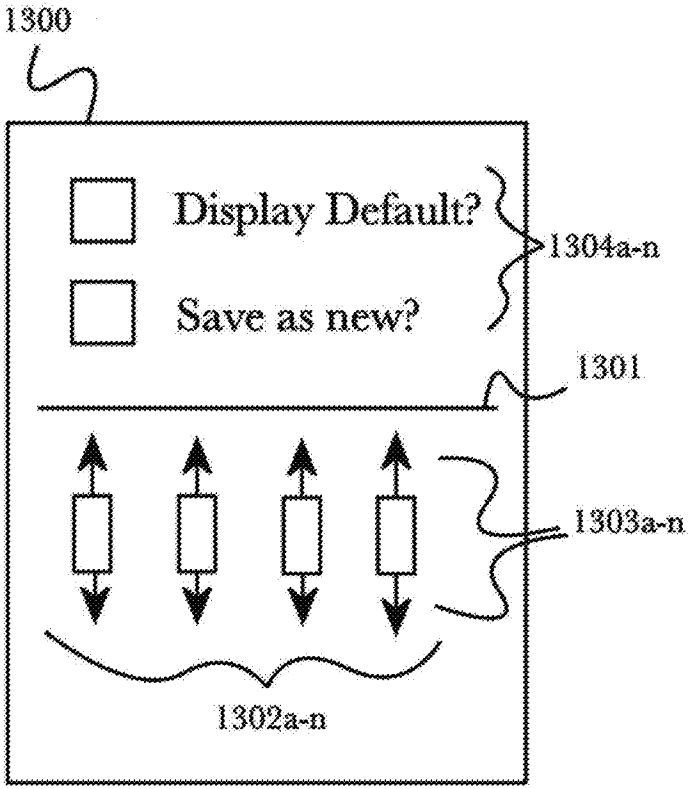

FIG. 13 shows an exemplary application screen that may open when a user has deployed boat fenders according to a preferred embodiment of the invention.

Figure 14:
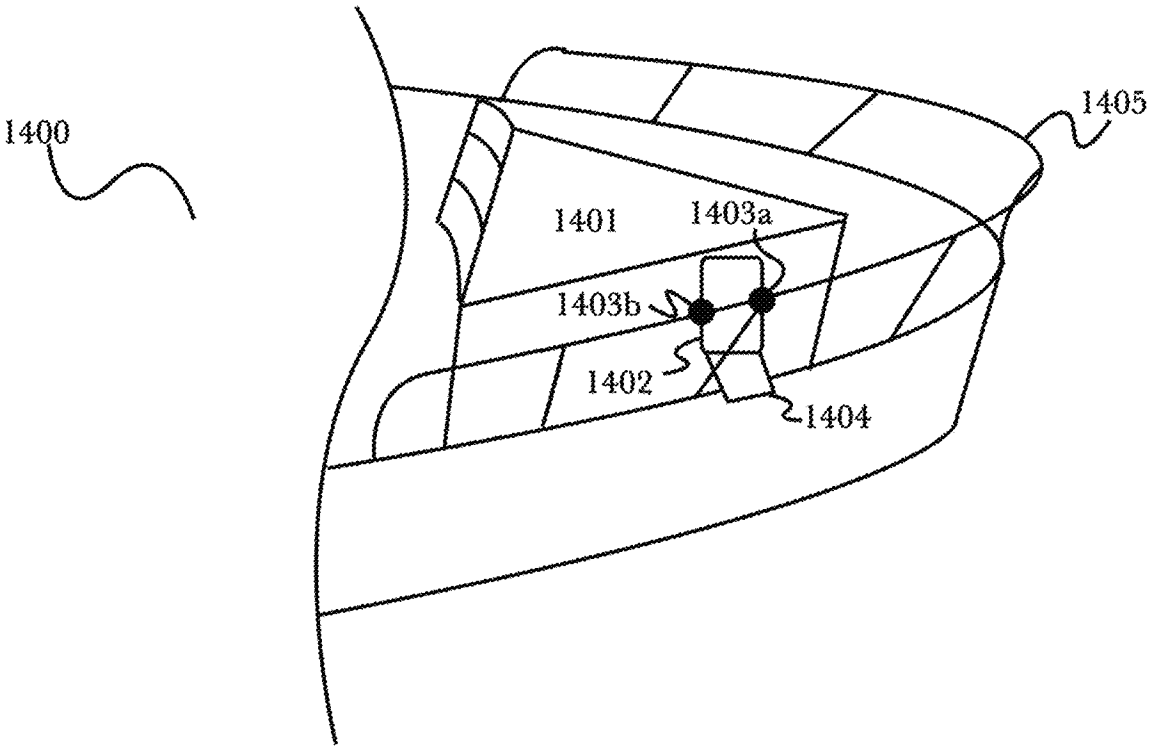

FIG. 14 shows an exemplary representation of a boat prow where the basket is mounted on one or more hinges according to a preferred embodiment of the invention.

Figure 15:
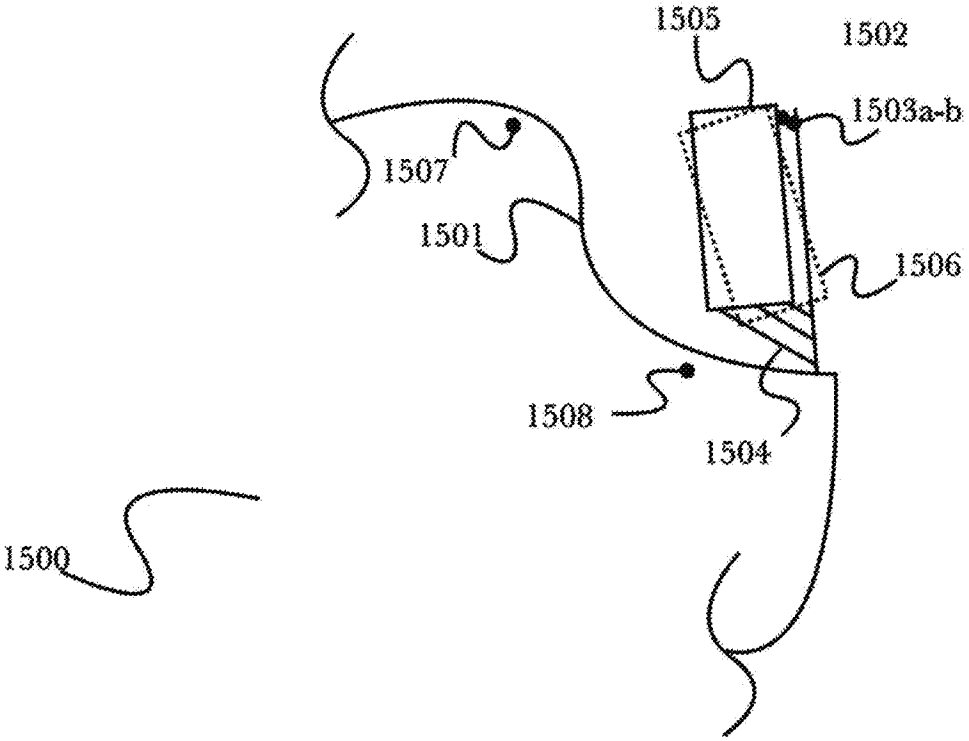

FIG. 15 shows an exemplary cross section of a boat with a representative basket secured by mounting hinges and a chute that aids in deployment according to a preferred embodiment of the invention.

Figure 16:
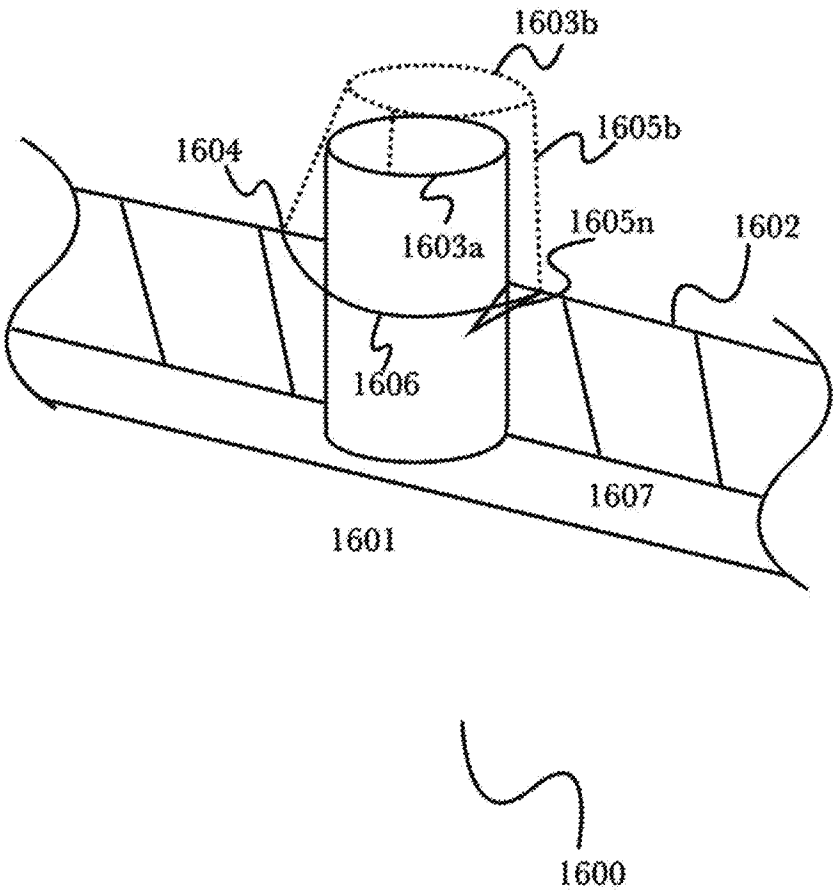

FIG. 16 shows a diagram of an alternative method to recess the basket according to a preferred embodiment of the invention.

Figure 17:
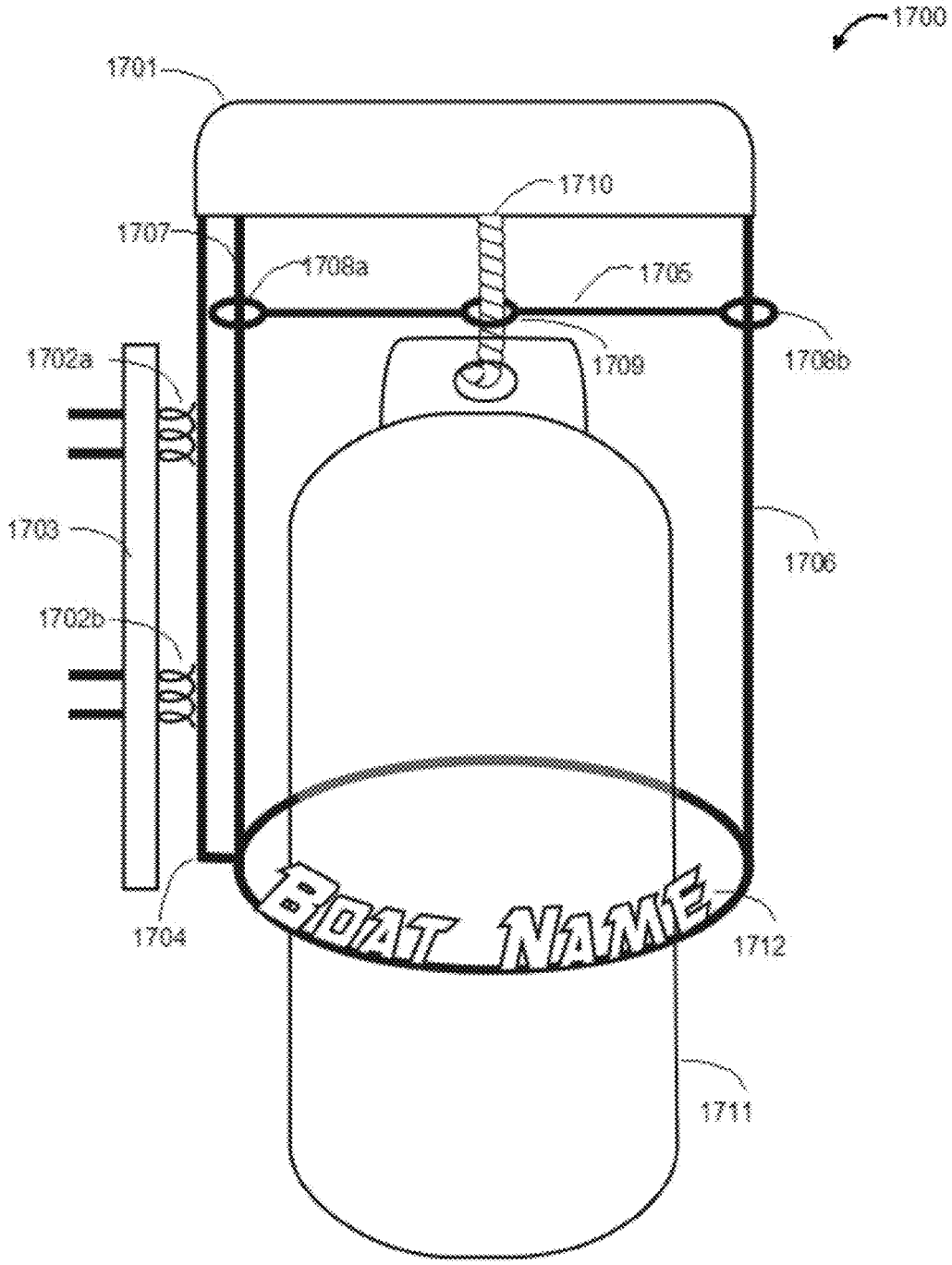

FIG. 17 shows an exemplary representation of an enhanced boat fender basket according to a preferred embodiment of the invention.

Figure 18:
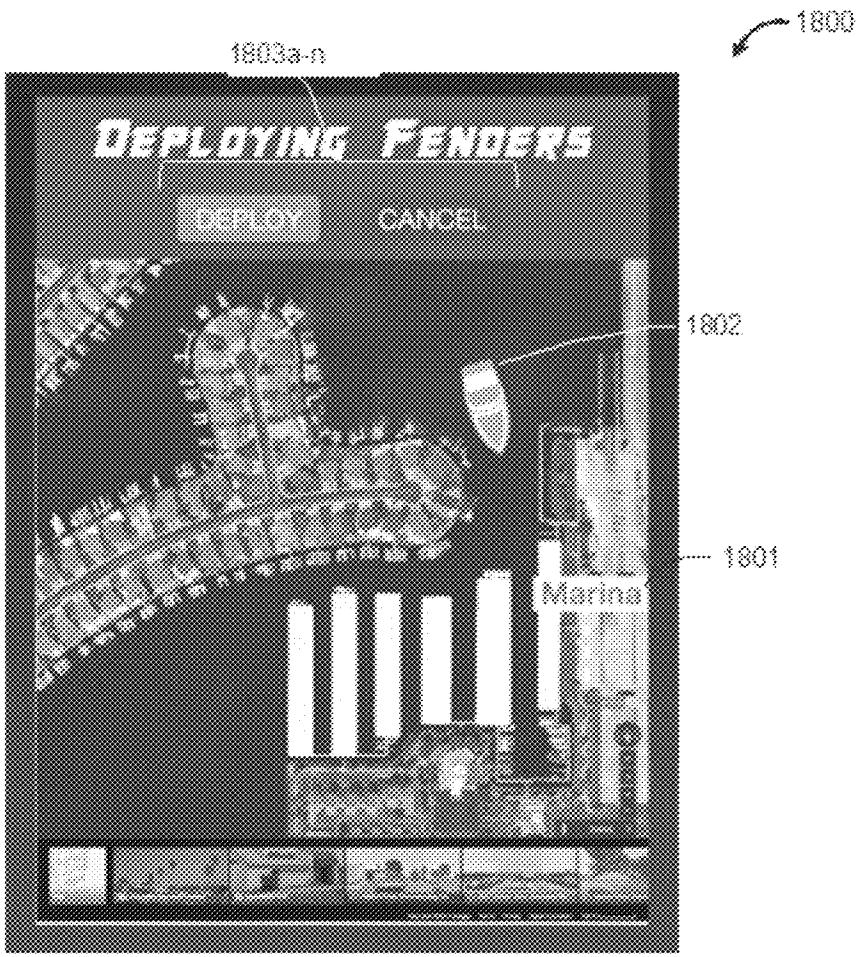

FIG. 18 shows an exemplary fender deployment reminder pop-up screen according to a preferred embodiment of the invention.

Figure 19:
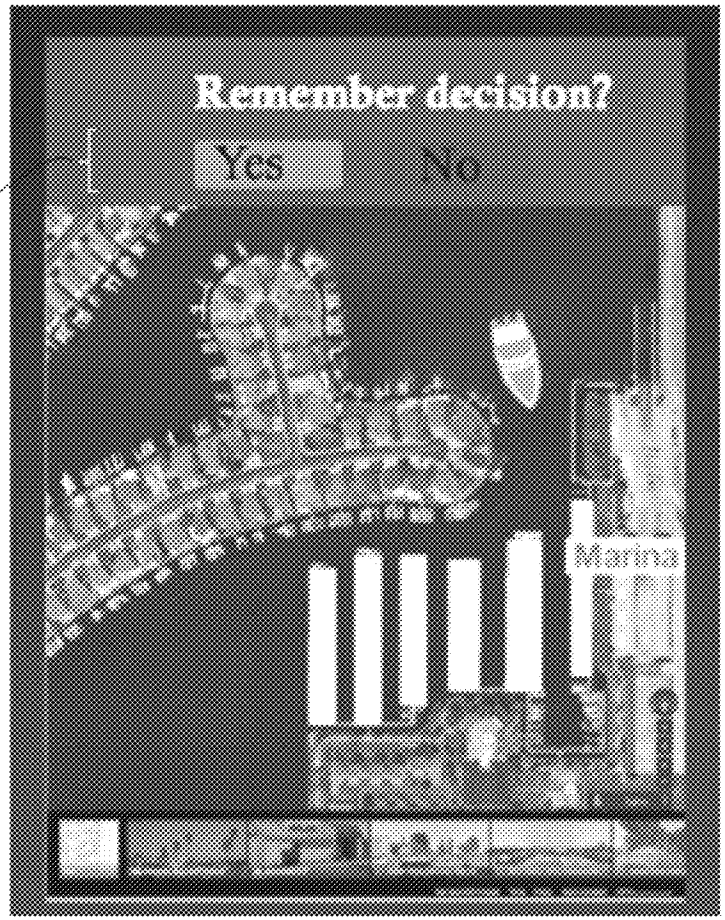

FIG. 19 shows a screenshot in which the system prompts the user whether to remember the decision.

Figure 20:
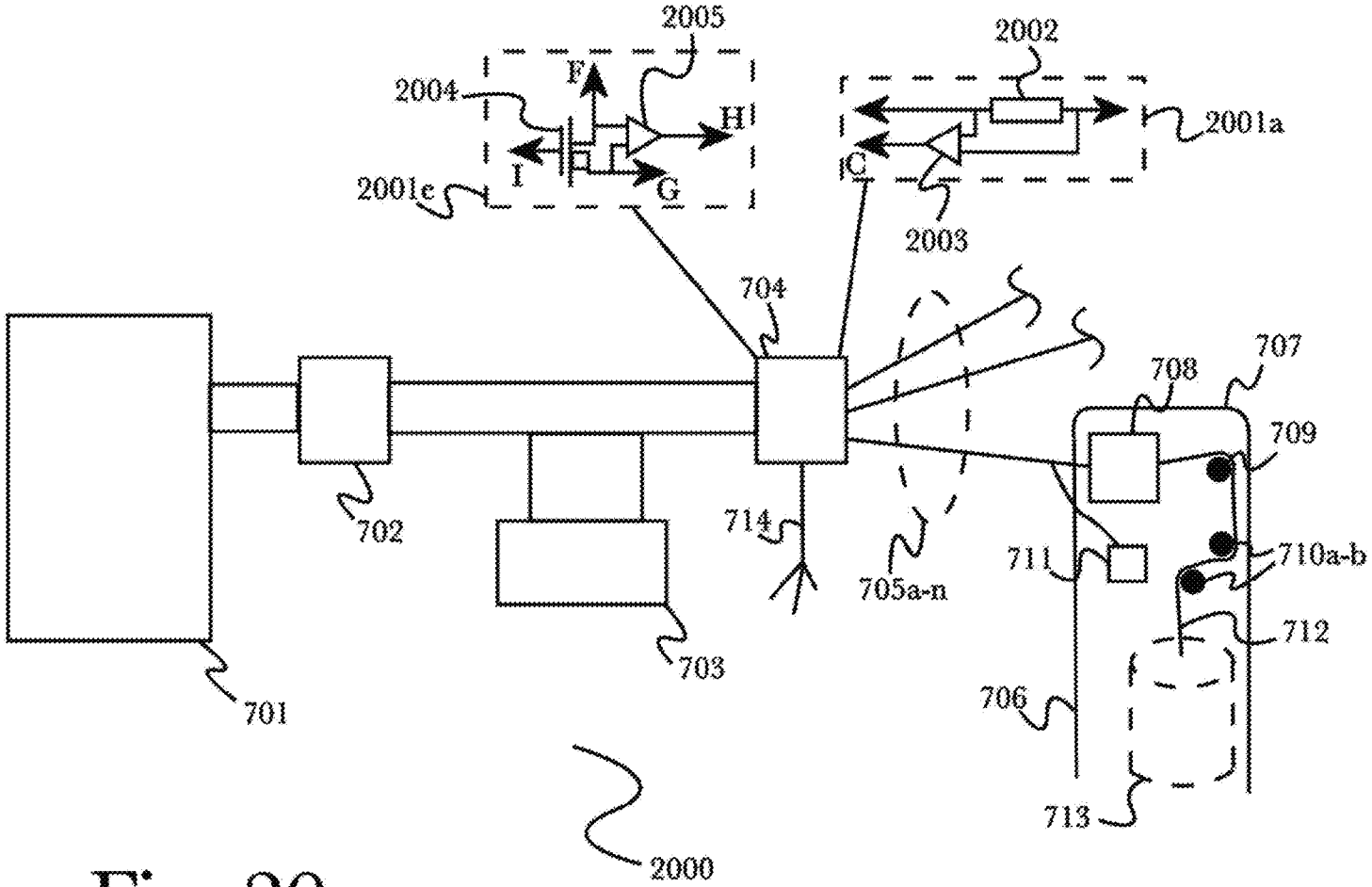

FIG. 20 shows an exemplary representation of two alternative methods for protecting a boat motor and electronic circuitry from overload due to problems with raising a boat fender.

Figure 21:
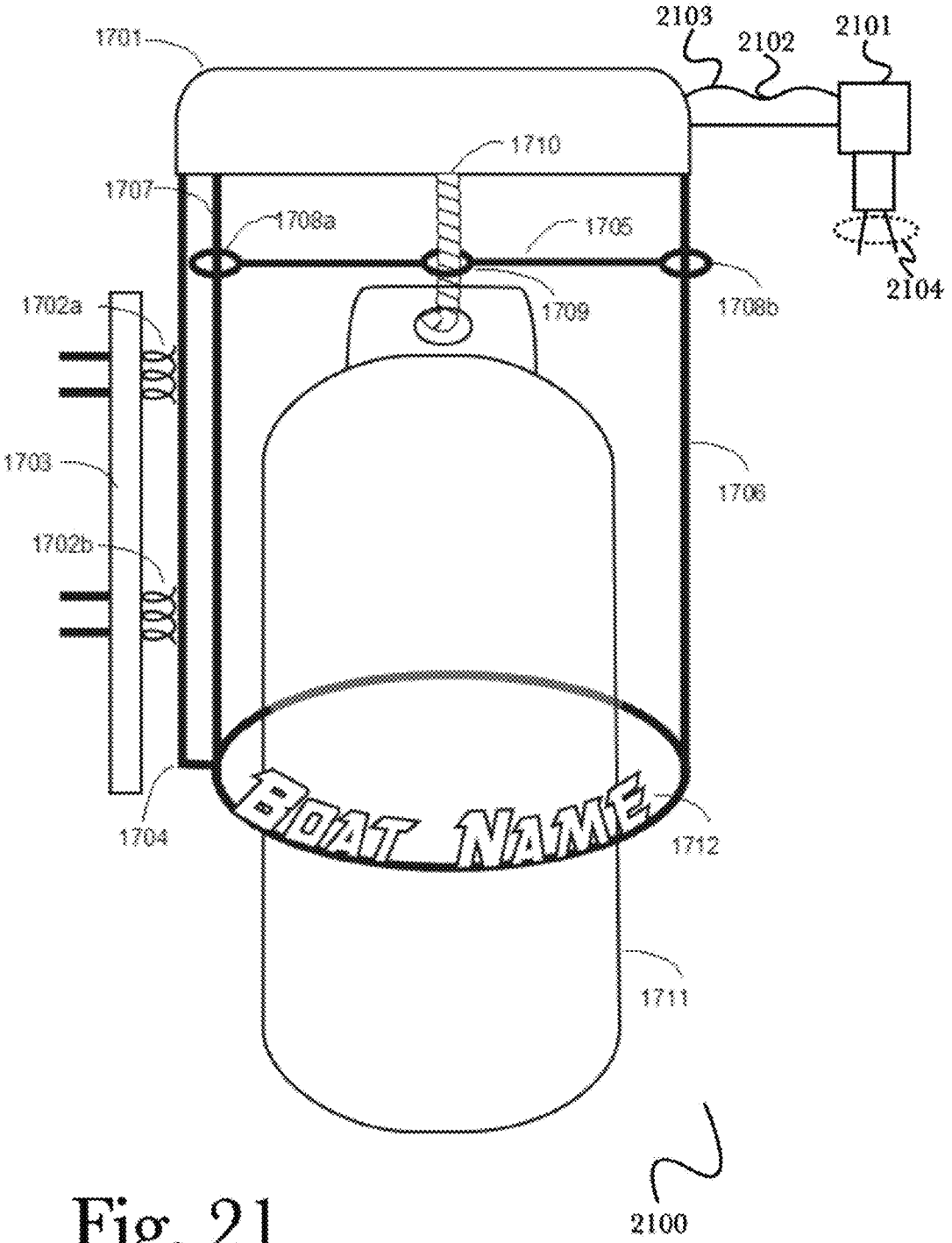

FIG. 21 shows an exemplary representation of an approach for viewing entanglements or other problems preventing a boat fender from being fully raised.

Figure 22:
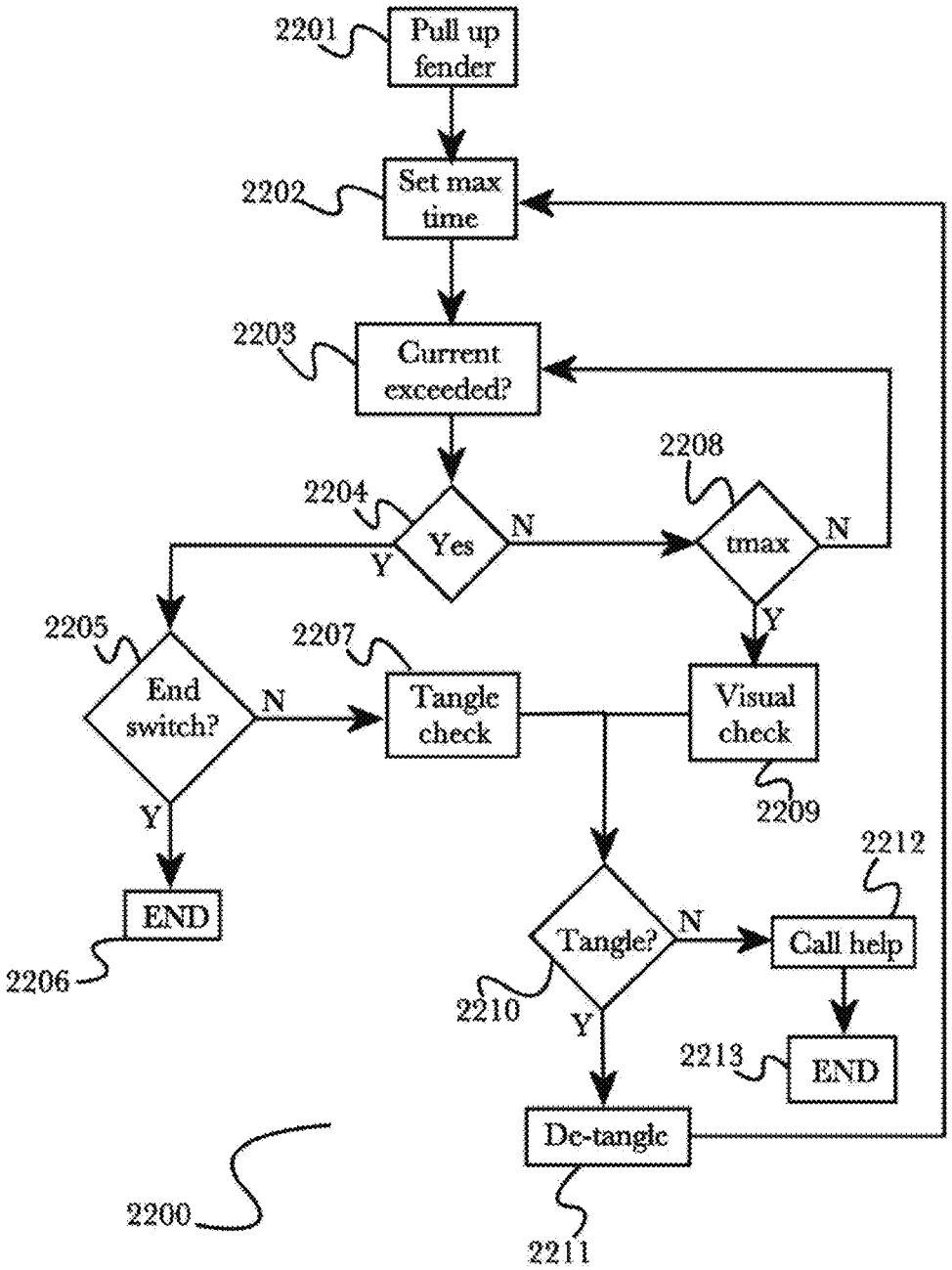

FIG. 22 shows a process for resolving problems with raising a fender.

Figure 23:
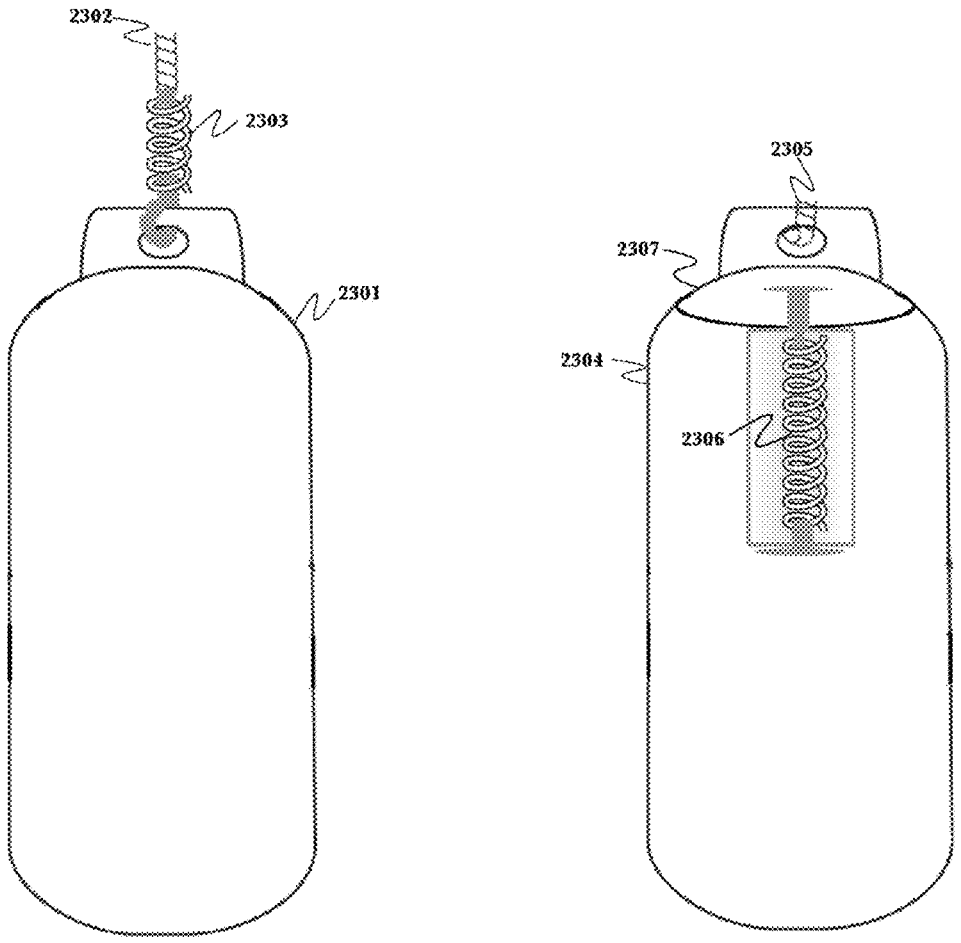

FIG. 23 shows a pair of embodiments with elastic members to mitigate forces transmitted from a fender to a mechanism of the invention.

Figure 24:
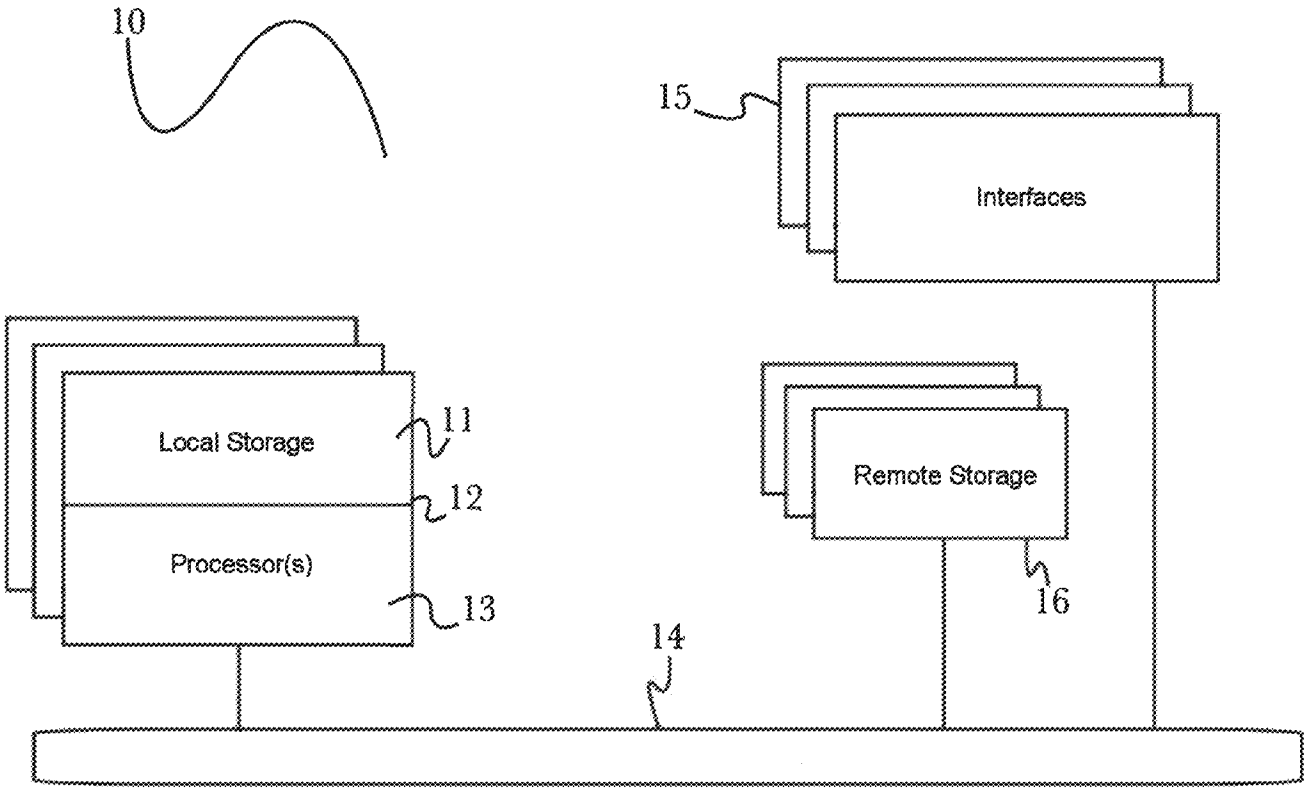

FIG. 24 is a block diagram illustrating an exemplary hardware architecture of a computing device used in an embodiment of the invention.

Figure 25:
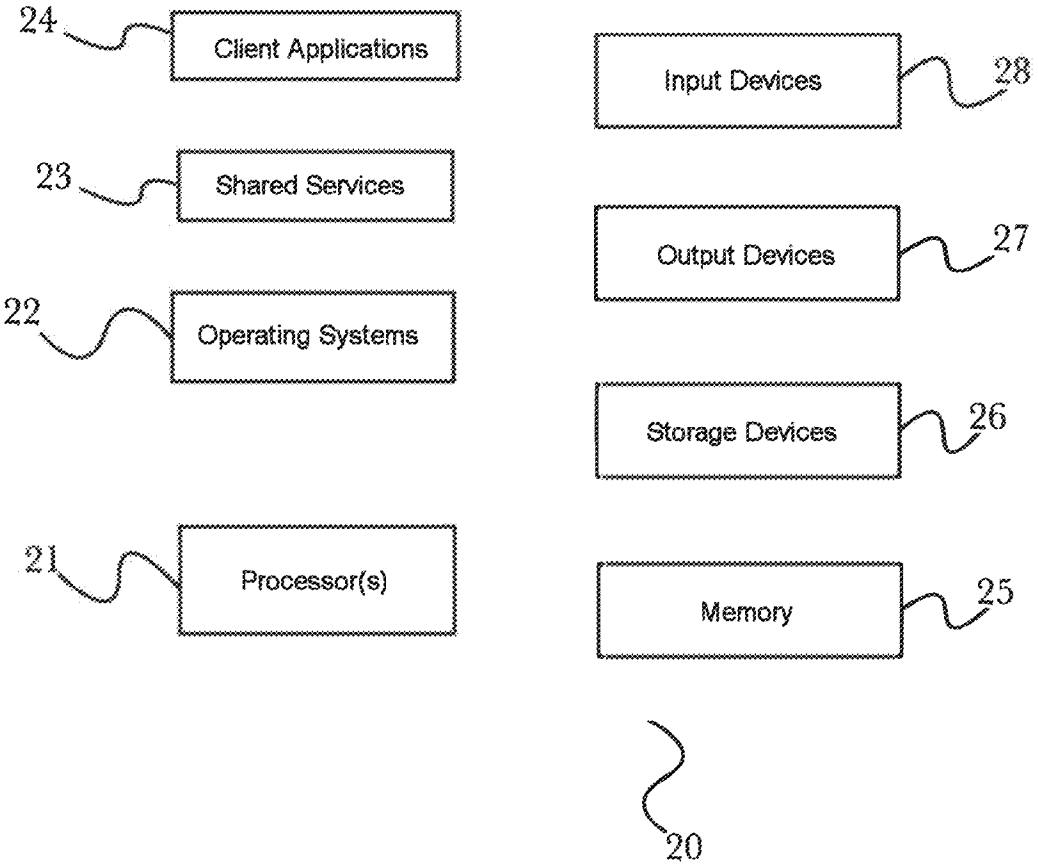

FIG. 25 is a block diagram illustrating an exemplary logical architecture for a client device, according to an embodiment of the invention.

Figure 26:
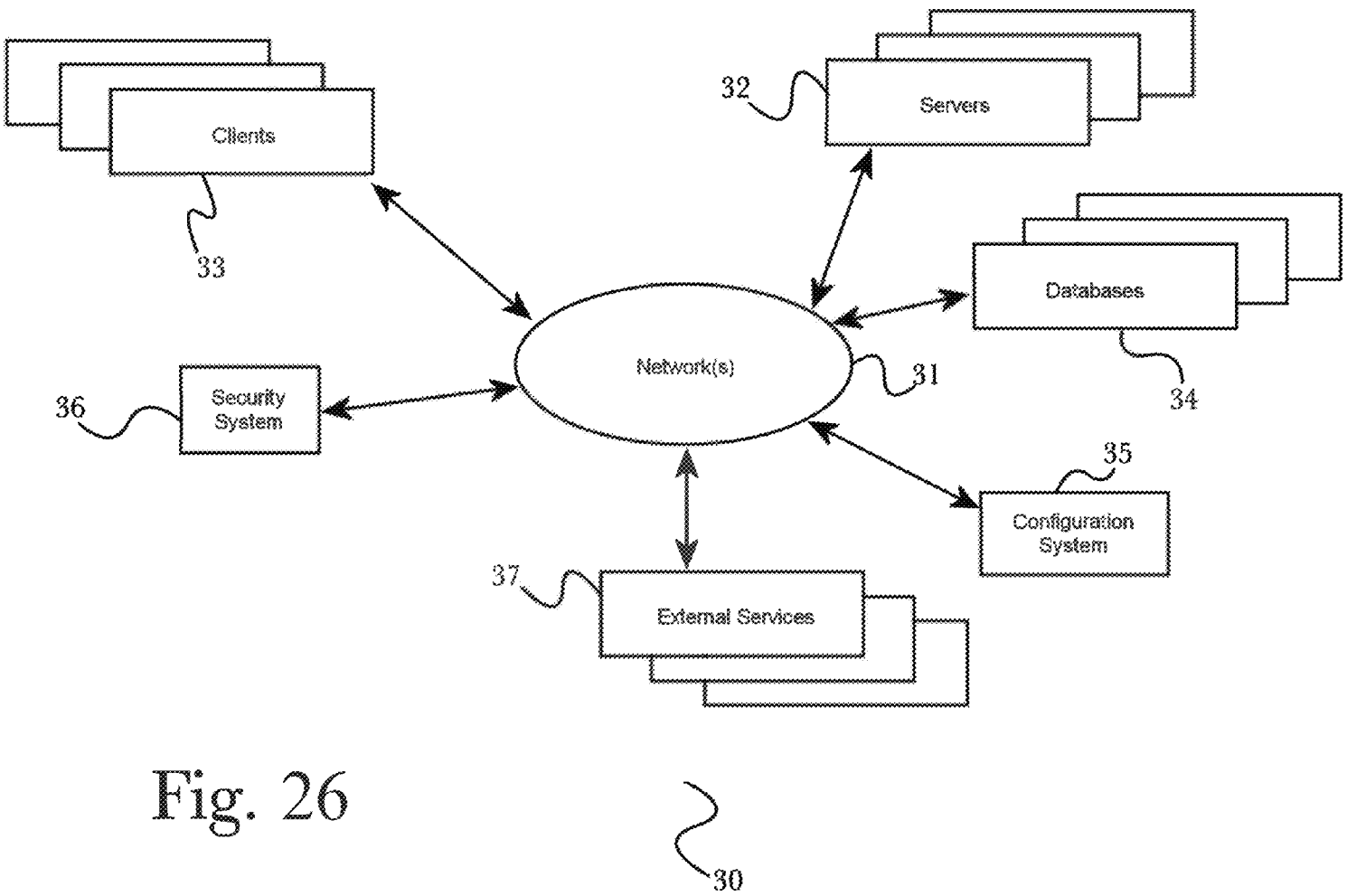

FIG. 26 is a block diagram showing an exemplary architectural arrangement of clients, servers, and external services, according to an embodiment of the invention.

Figure 27:
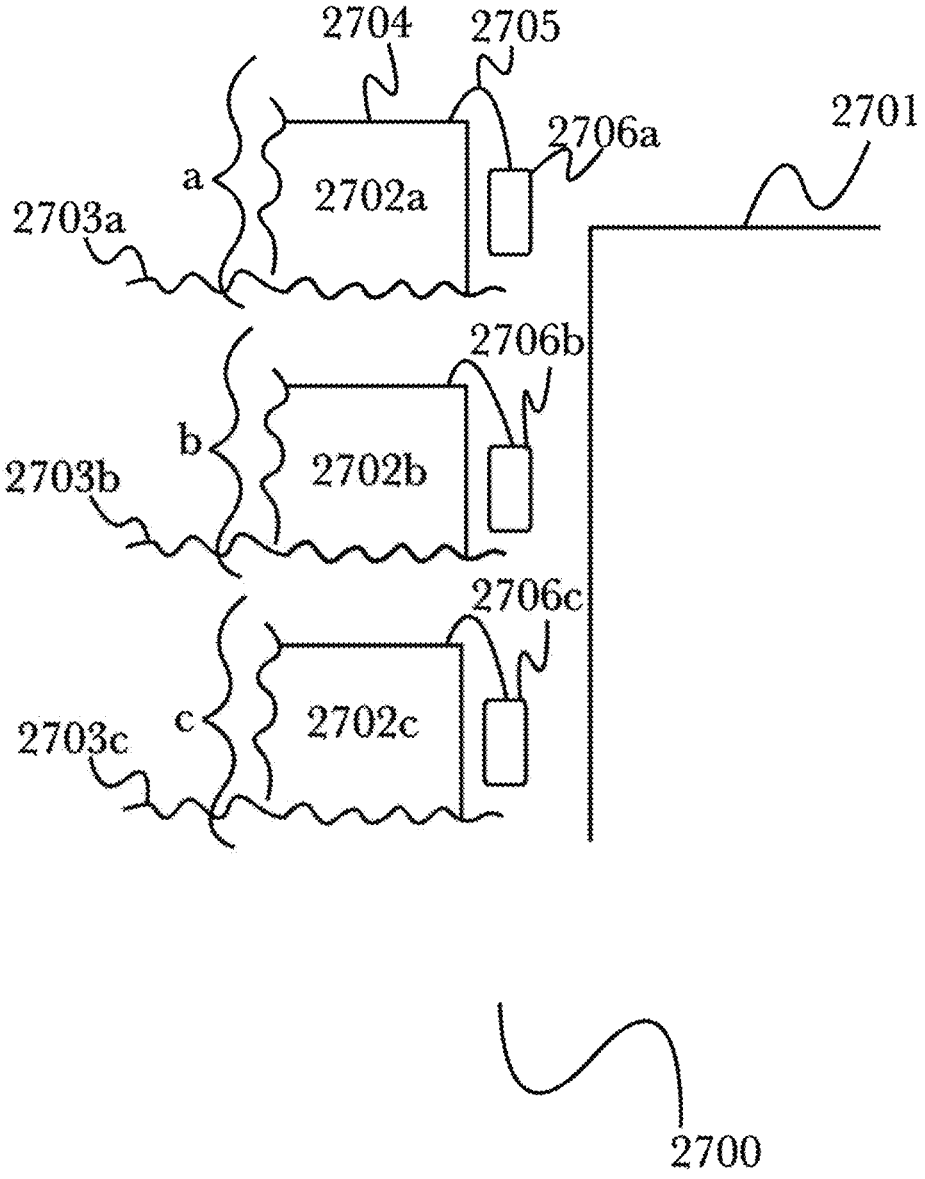

FIG. 27 shows the effect of tidal range on docking levels and resulting need for changes in fender positioning.

Figure 28:
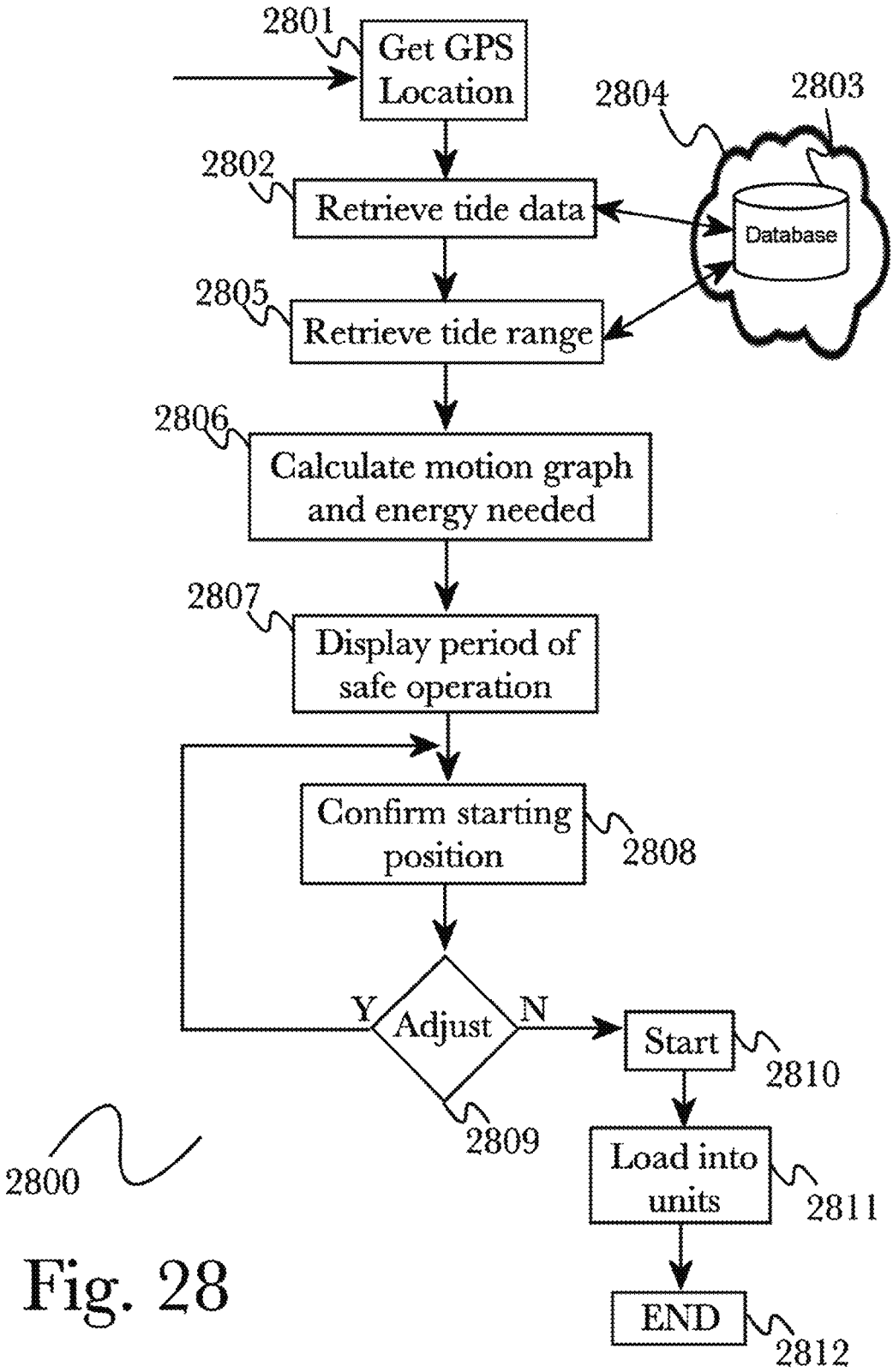

FIG. 28 shows the process for calculating and initiating automatic vertical adjustment of a boat fender.

Figure 29:
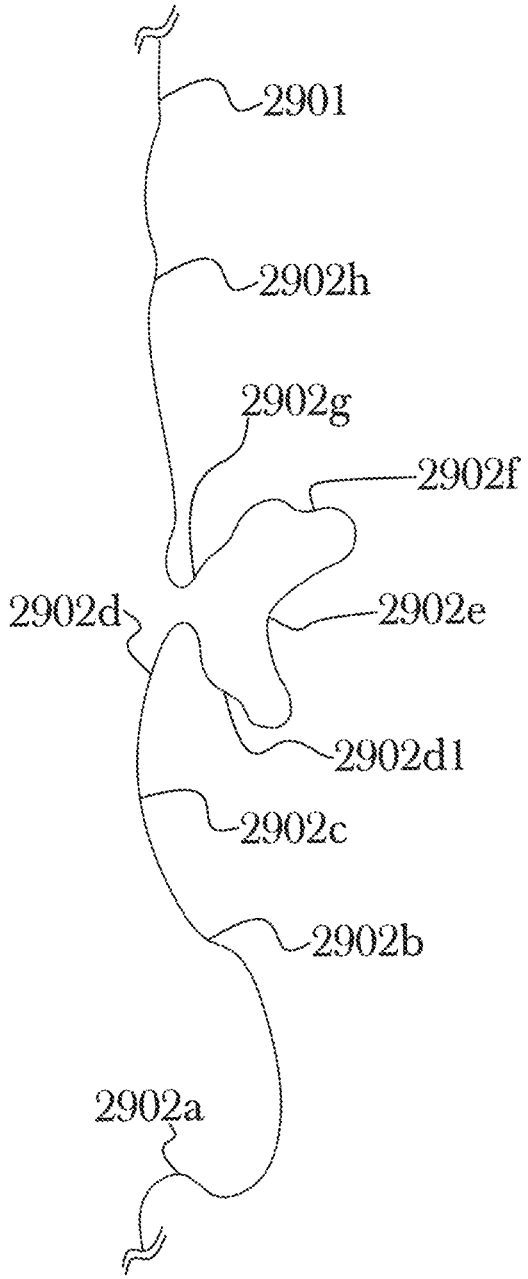

FIG. 29 shows an example of a boat trip.

Figure 30:
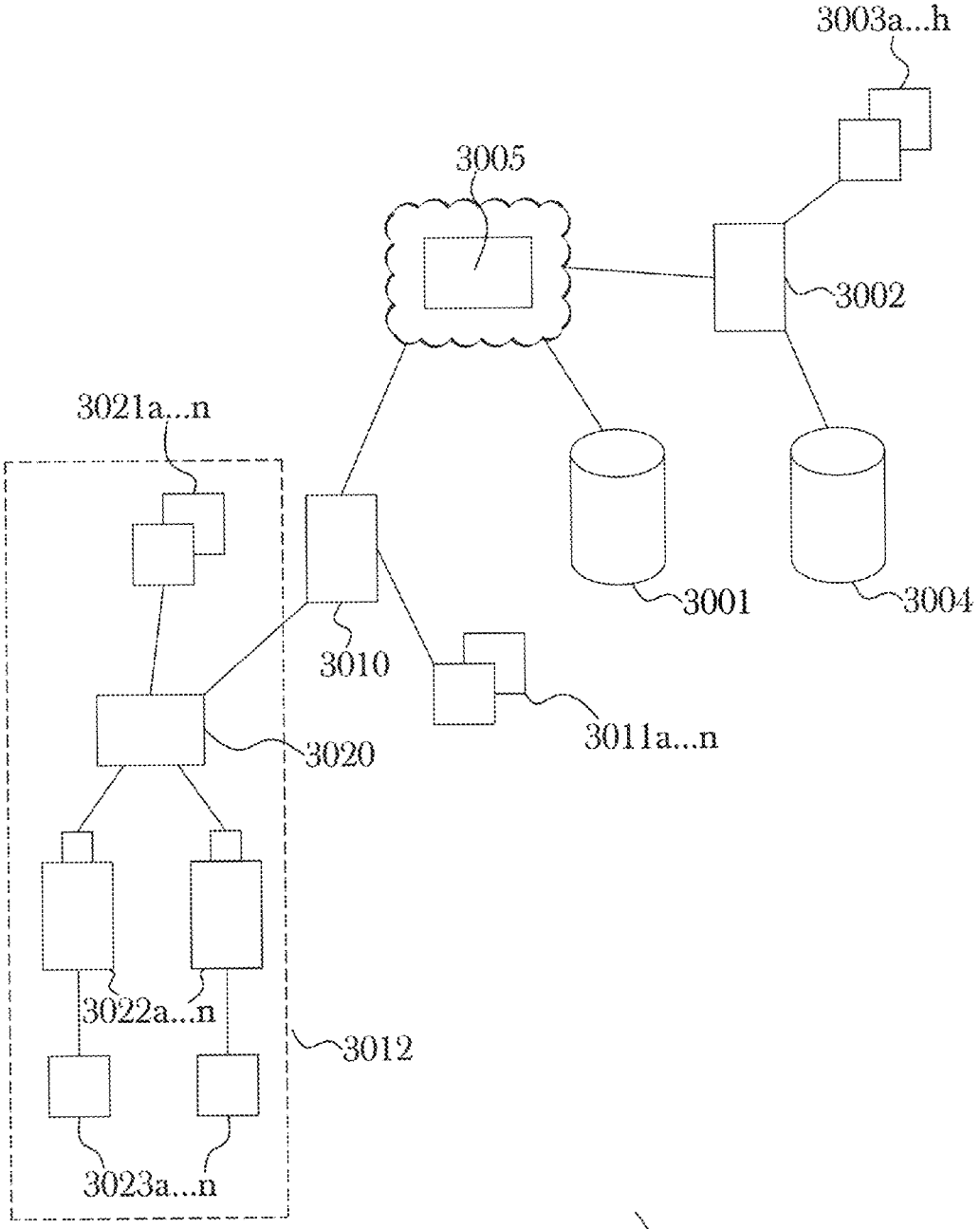

FIG. 30 is a system diagram of a preferred embodiment of the invention.

Figure 31:
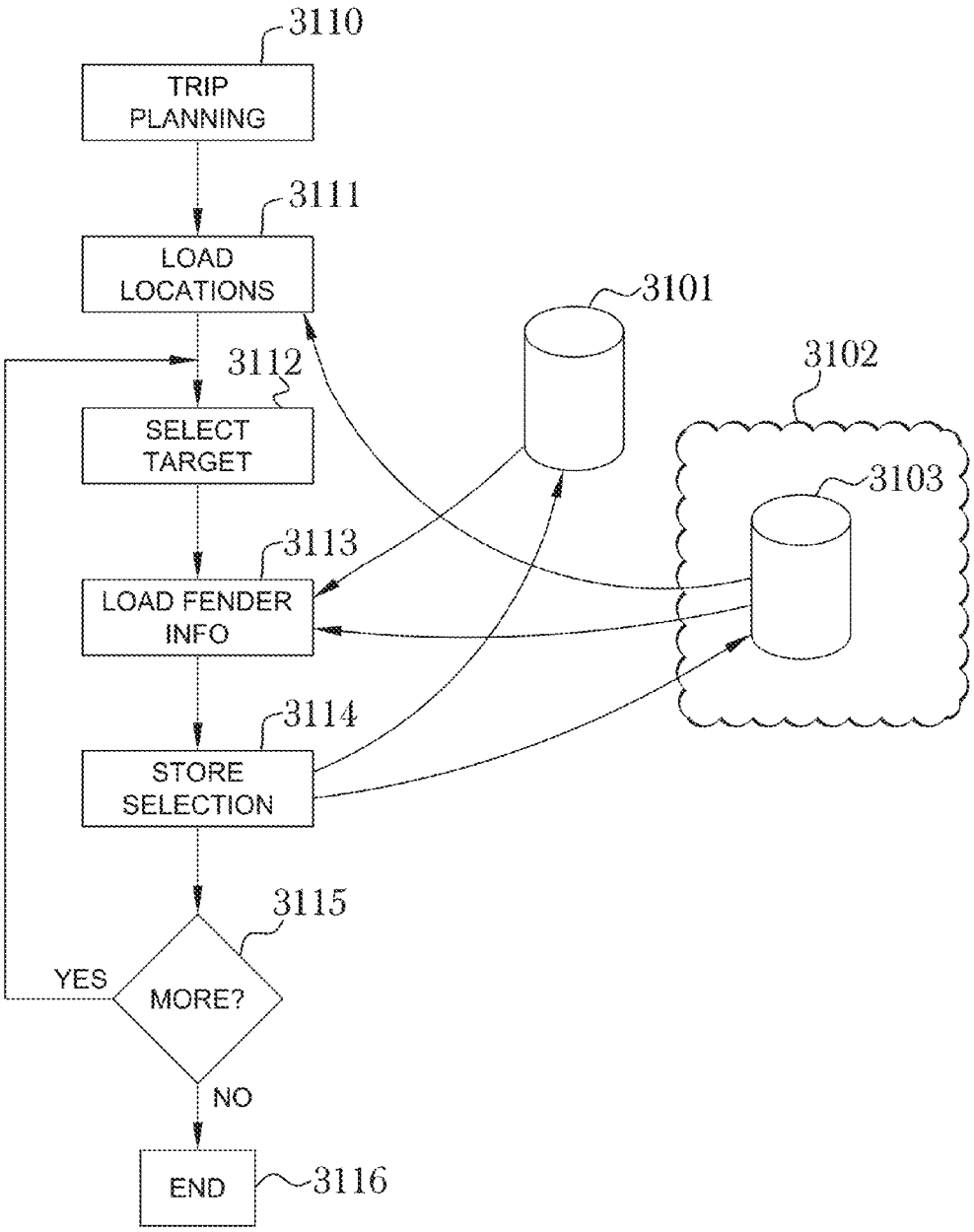

FIG. 31 is a method diagram illustrating a method of planning according to a preferred embodiment of the invention.

Figure 32:
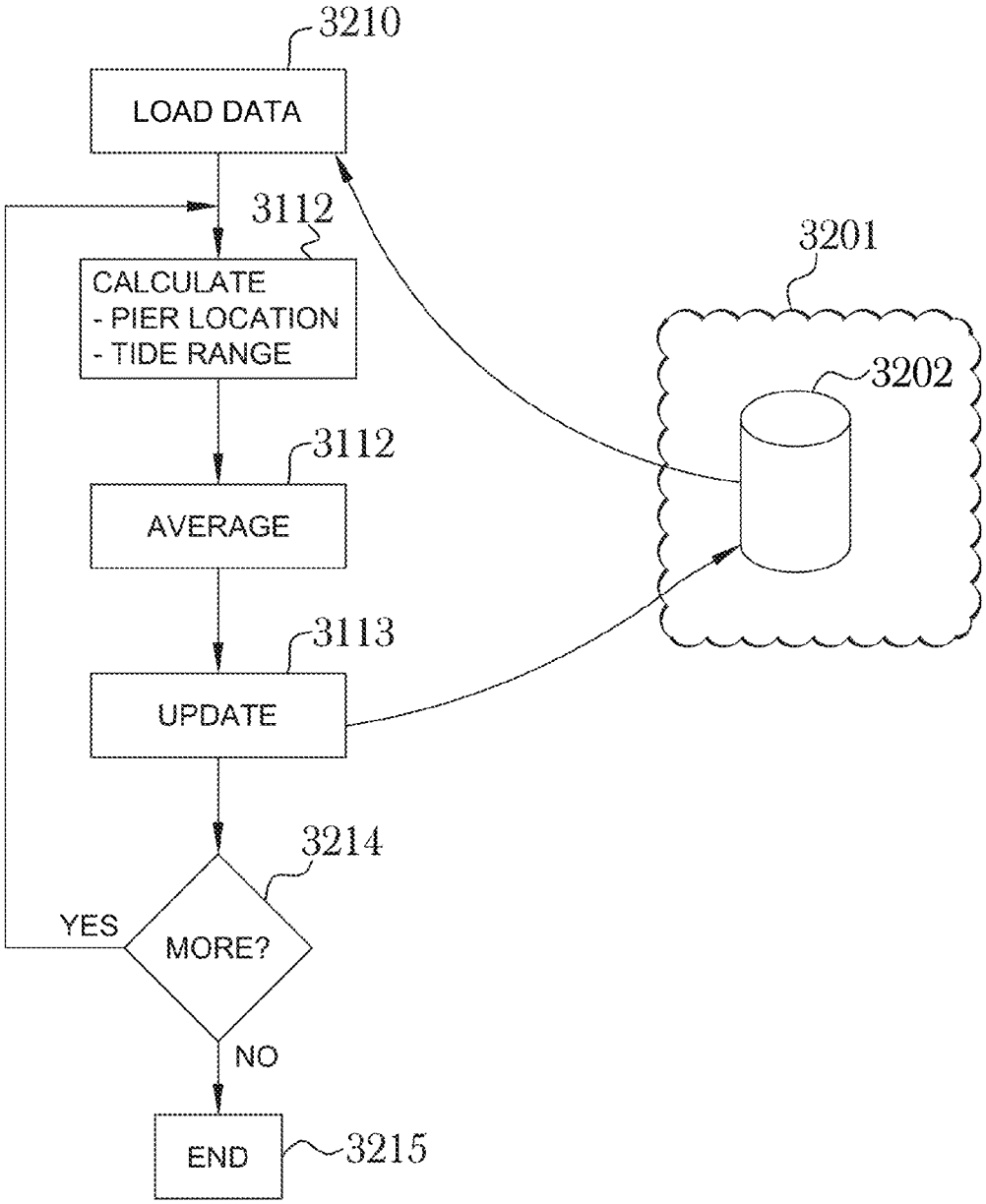

FIG. 32 is a method diagram illustrating a further method according to a preferred embodiment of the invention.

Figure 33:
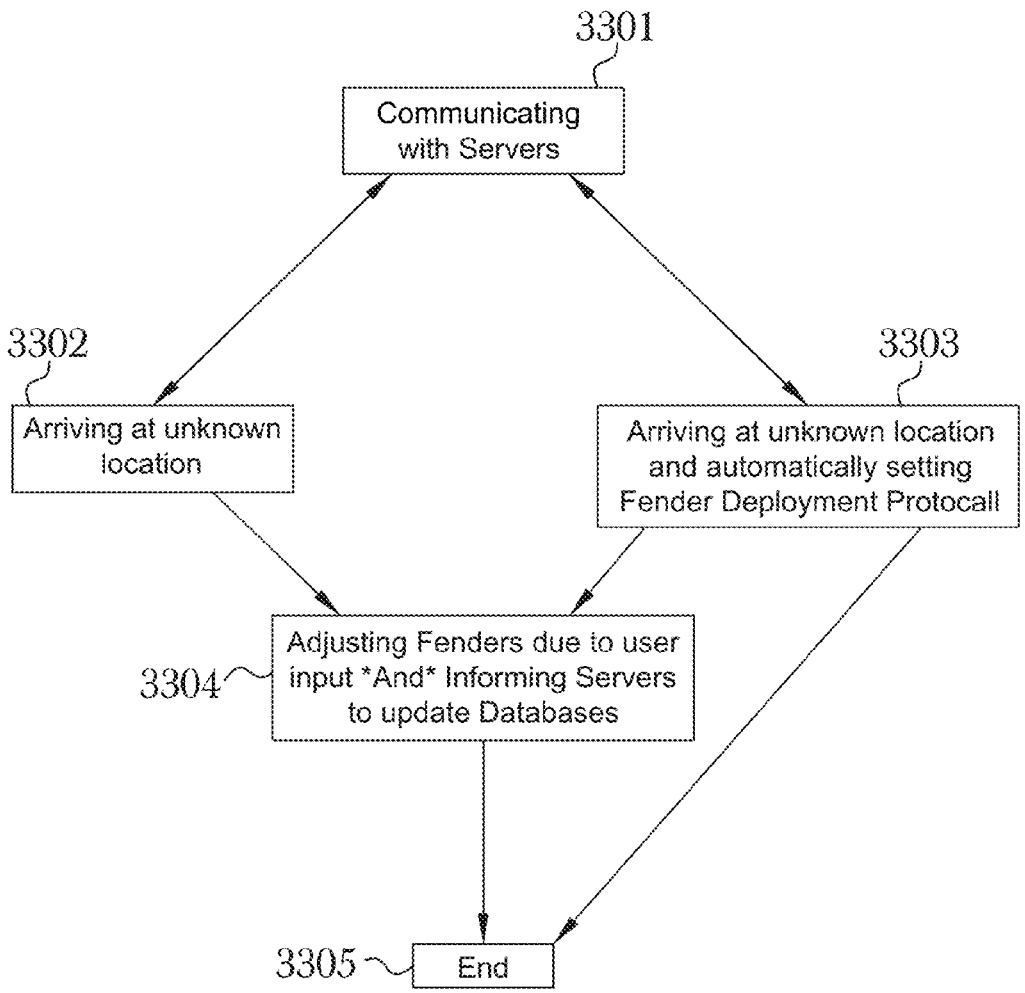

FIG. 33 is a method diagram illustrating a method for collection of data accessible by network for boat fenders automated deployment according to a preferred embodiment of the invention.

Figure 34:
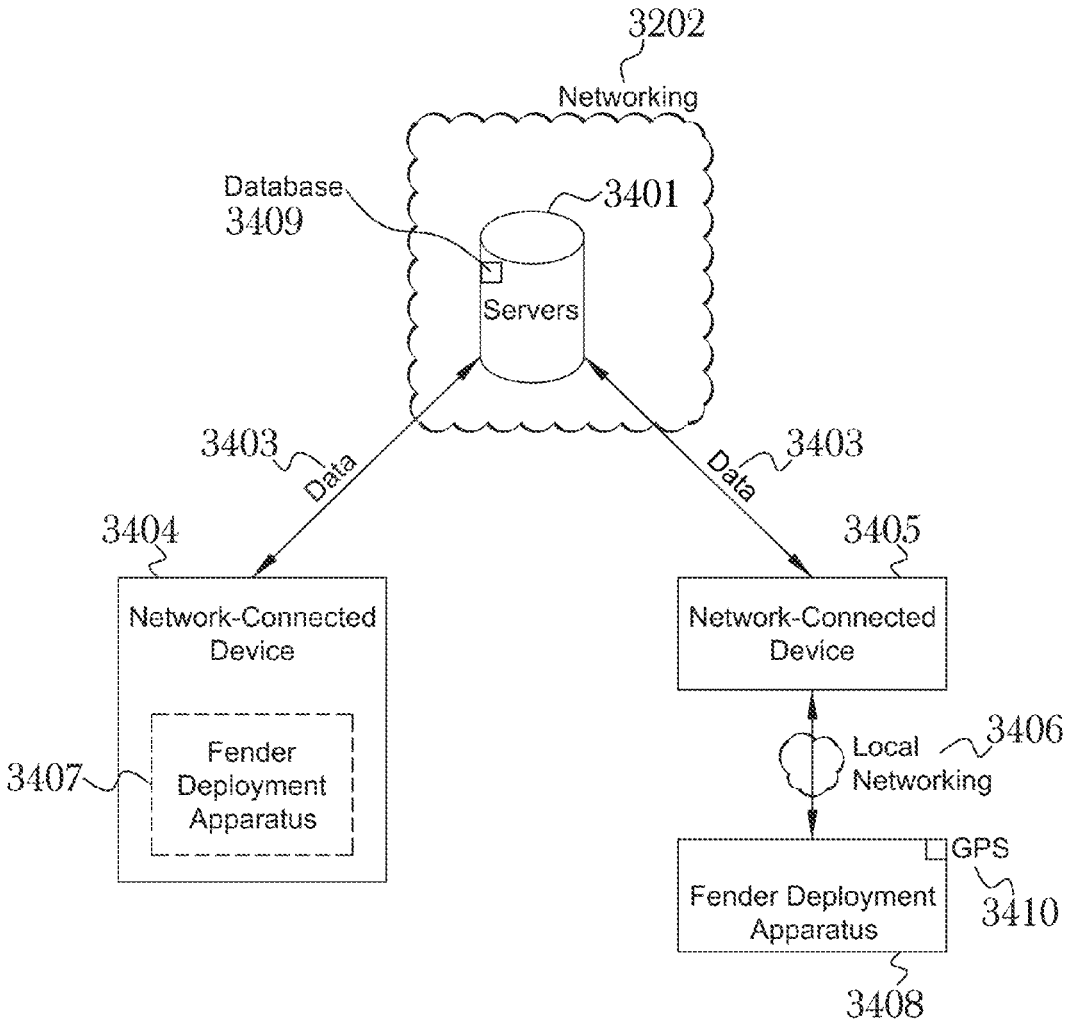

FIG. 34 is a system diagram illustrating a system for collection of data accessible by network for boat fender's automated deployment according to a preferred embodiment of the invention.

DETAILED DESCRIPTION

The inventor has conceived, and reduced to practice, a system and method for planning and predetermination of fender heights and dock location information.

One or more different inventions may be described in the present application. Further, for one or more of the inventions described herein, numerous alternative embodiments may be described; it should be understood that these are presented for illustrative purposes only. The described embodiments are not intended to be limiting in any sense. One or more of the inventions may be widely applicable to numerous embodiments, as is readily apparent from the disclosure. In general, embodiments are described in sufficient detail to enable those skilled in the art to practice one or more of the inventions, and it is to be understood that other embodiments may be utilized and that structural, logical, software, electrical and other changes may be made without departing from the scope of the particular inventions. Accordingly, those skilled in the art will recognize that one or more of the inventions may be practiced with various modifications and alterations. Particular features of one or more of the inventions may be described with reference to one or more particular embodiments or figures that form a part of the present disclosure, and in which are shown, by way of illustration, specific embodiments of one or more of the inventions. It should be understood, however, that such features are not limited to usage in the one or more particular embodiments or figures with reference to which they are described. The present disclosure is neither a literal description of all embodiments of one or more of the inventions nor a listing of features of one or more of the inventions that must be present in all embodiments.

Headings of sections provided in this patent application and the title of this patent application are for convenience only, and are not to be taken as limiting the disclosure in any way.

Devices that are in connection with each other need not be continuously connected with each other, unless expressly specified otherwise. In addition, devices that are in connection with each other may connect directly or indirectly through one or more intermediaries, logical or physical.

A description of an embodiment with several components in connection with each other does not imply that all such components are required. To the contrary, a variety of optional components may be described to illustrate a wide variety of possible embodiments of one or more of the inventions and in order to more fully illustrate one or more aspects of the inventions. Similarly, although process steps, method steps, algorithms or the like may be described in a sequential order, such processes, methods and algorithms may generally also work in alternate orders, unless specifically stated to the contrary. In other words, any sequence or order of steps that may be described in this patent application does not, in and of itself, indicate a requirement that the steps be performed in that order. The steps of described processes may be performed in any order practical. Further, some steps may be performed simultaneously despite being described or implied as occurring sequentially (e.g., because one step is described after the other step). Moreover, the illustration of a process by its depiction in a drawing does not imply that the illustrated process is exclusive of other variations and modifications thereto, does not imply that the illustrated process or any of its steps are necessary to one or more of the invention(s), and does not imply that the illustrated process is preferred. Also, steps are generally described once per embodiment, but this does not mean they must occur once, or that they may only occur once each time a process, method, or algorithm is carried out or executed. Some steps may be omitted in some embodiments or some occurrences, or some steps may be executed more than once in a given embodiment or occurrence.

When a single device or article is described, it will be readily apparent that more than one device or article may be used in place of a single device or article. Similarly, where more than one device or article is described, it will be readily apparent that a single device or article may be used in place of the more than one device or article.

The functionality or the features of a device may be alternatively embodied by one or more other devices that are not explicitly described as having such functionality or features. Thus, other embodiments of one or more of the inventions need not include the device itself.

Techniques and mechanisms described or referenced herein will sometimes be described in singular form for clarity. However, it should be noted that particular embodiments include multiple iterations of a technique or multiple manifestations of a mechanism unless noted otherwise. Process descriptions for computing equipment or such blocks in figures should be understood as representing modules, segments, or portions of code which include one or more executable instructions for implementing specific logical functions or steps in the process. Alternate implementations are included within the scope of embodiments of the present invention in which, for example, functions may be executed out of order from that shown or discussed, including substantially concurrently or in reverse order, depending on the functionality involved, as would be understood by those having ordinary skill in the art.

Detailed Description of Exemplary Embodiments

The system and method disclosed herein uses a lift system for fenders, with baskets providing secure stowage for fenders when not in use. Additionally, an application on a smartphone may remind the crew to lower the fenders when approaching a dock and possibly, based on previous dockings, a reminder for a mark on the line where to cleat or fast cleat the line, so the fender has the appropriate height for that dock. In some cases the application may provide a reminder or in other cases the application may actually perform the fender deployment operation (as the baskets are motorized in those cases). In most cases the fender is positioned at the same height while docking, but in some situations different heights may be necessary.

In some cases, a basket for stowing a fender is used, that is sometimes attached to a part of a vessel or boat, and the basket has an opening for threading through a line (in some cases with a pulley), the line attached to a fender, the line operable by a user to pull up the fender into the basket through a second opening at the bottom of the basket. Typically, the basket has at least one moveable, hinged section, the section formed in such a manner, that when pulling up the fender to the top, the movable section is clamping in on the fender and securing it. In some cases, the basket and the moveable section can be made of a rigid material such as a metal, suitable for marine use. In other cases, a majority of the parts are made from a soft plastic material suitable for molding. In yet other cases, the parts of the basket are made of a combination of rigid metal parts and soft plastic materials. Additionally, in some cases a fast cleat is provided to secure the line in at least two positions, one of which has the fender full retracted and at least one other having the fender deployed, and wherein the fast cleat may be mounted in an easy to reach location on the vessel. Further, an application for use on smartphone may be provided, and the application has access to a third party map system. The application also has access to the GPS system of the smartphone. When approaching a docking site, the application may be used by a user to add locations used by the vessel for landing, and the user may enter a mark representing the height of the fenders deployed. In some cases, the application will display and or make heard a reminder to deploy at least one fender, and that display will include the previously stored height mark for deploying the fender. In yet other cases, the basket for stowing a fender will have a cleat or auto cleat to allow the line to be secured at any position. In some of these cases the cleat is attached to or near the basket. Furthermore, in some cases the cleat can be released with a controlled jerking of the line. In some cases, the line may be routed inside the basket and exit from the same opening as the fender.

In additional cases, the system and method disclosed herein uses wired or wireless communication, such as, for example, Bluetooth, Zigbee, and the like, to control automatic deployment and retraction of boat fenders. The mechanism can be powered by solar or the boat DC.

In some other cases, a system may comprise a basket for lowering one or multiple boat fenders, with the fender attached to a line that is coupled to a winch that is coupled to a motor, with the motor controlled by a controller that may be activated via wireless control signals. Power for the motor may be drawn from a battery, which may be the onboard power supply or, alternatively, may be separately charged from a solar panel. Alternatively, each basket may have an individual controller, battery, and solar panel, not requiring any wiring between the units.

In some cases, the system and its methods enable these fenders to be controlled from a mobile computing device, such as a smartphone or tablet, both of which should be considered equivalent for all purposes here. Additionally, in some cases, based on repeated visits, the fenders can deploy automatically based on the GPS location of the boat and the fact that its trajectory leads the boat to a landing slip, berth, dock etc.

In further cases, a smartphone with an app may be used to control one or more of the basket controllers and a multitude of automatic baskets. The app can also control baskets based on previous programming, without requiring user interaction, and, additionally, based on distance to a landing site derived from GPS data and map data, can prompt the user for an action and can memorize that action for future use. This app may include a dedicated control panel to wirelessly control one or more controllers of baskets, using Bluetooth or Wi-Fi etc. as a wireless protocol.

In some cases, rather than a smart phone or tablet, an onboard navigation system or some other computerized boat system may be upgraded or extended to add the control functionality. This could be done via wired or wireless control of motorized buckets. For purposes, here, they all should be considered equivalent and a may have a GPS enabled computing device.

In some cases, rather than mounting a basket to the railing, a basket type tube could be integrated into the hull of a boat, similar to a torpedo tube and with or without an outer door protecting the fender when not in use. It may be designed outside the displacement section of the boat hull, thus eliminating complicated locks on the inside, and additionally not requiring waterproofing of the interfaces. For purposes herein, it would be considered essentially equivalent.

In additional cases, in a system with one or more baskets for lowering one or more fenders attached to a line, each basket may be mounted with one or more hinges so the basket can swing out from the boat's outline, for easy deployment of a fender. Further, each basket may be controlled for the swing-out with a lever attached to the boat and used to initiate and stop or reverse the swing-out action of the basket. This lever may be a hinged arm and may be operated manually or by a motor. In some cases, the basket may be mounted substantially within the boat's outline and angled so the fender may be lowered through an opening in the railing over the edge of the boat's board. The basket, in such cases, may also have an additional slide extension at the bottom opening to extension guide the fender over the edge of the boat. The basket may, in such cases, extend out through an opening in the railing to facilitate easier deployment of the fender, which deployment may be accomplished either manually or with the help of a motor, and the swing-out may be achieved with the help of an additional motor.

In some cases, the winch may feed the unused line into a small basket or storage compartment that will hold the unused section. In yet other cases, a spool maybe used to wind on and store unused sections. In yet other cases, rather than normal line or rope, chains made of metal and or plastic material may be used, and the winch may have matching grooves that garb the chain links.

In additional cases, the basket for lowering fenders has a moveable bar across the opening; this bar, which can move along the cylindrical axis of the basket and is pulled up alongside the fender into the basket, has a small opening for guiding the line, as well as additional openings or features for guiding itself up and down the basket. Further, an external force can make the basket swing back into the hull line, counteracting at least a spring, connected to the hinge, that moves the basket outside the hull line for normal operations. In some cases, the line may be coupled to a motor-driven winch, with the motor controlled by wired or wireless signals.

In some cases, in a system with a basket and a mechanism for stowing a boat fender, upon retracting the fender, the system shuts off the motor if an over-current arises due to a tangle in the line or a catch of the fender below the basket. Upon such a shutdown of the motor, the system engages in a limited number of small reversals in an attempt to detangle the line and/or the fender and achieve a full retraction. Additionally, a camera and visual recognition software may be used to detect a tangle or other problem with the line or the fender, in addition to the current sensing. Further, upon attempting to retract the fender, the motor shuts off if a disturbance in the retraction motion is recognized by the visual recognition software due to a tangle in the line or a catch of the fender below the basket. In such cases, the system engages in a limited number of small reversals to attempt to detangle the line and or the fender and achieve a full retraction. Moreover, the current control may be used to aid the detangling control of the reversal of the line motion in addition to the camera. Additionally, if after several small reversals retraction of a fender is impossible, in some embodiments a user may be notified of the problem, and of the fact that a fender has not been fully retracted, thus alerting the user to a possible need for manual intervention.

In some cases, a system may control the vertical movement of boat fenders based on a tidal range chart, loading software into a fender controller to lift and lower fenders over a period of time as a boat rises and falls with water levels when docked at a vertically stationary dock. In such cases, when the rub rail of the boat falls below the level of the top of the dock, the bottom of the deck, or a predefined or calculated level of the dock, the fenders may no longer move vertically; and when the edge of the boat rises above the top or bottom of the dock, or any predefined or calculated level of the dock from the opposite side, the fenders may resume moving to protect the part of the boat that may contact the dock. In addition, the system may, optionally, calculate the battery power required to move the fenders over a given period of time and check the battery charge to ensure it has sufficient power, and then report its findings to the user. In further cases, the fender location relative to the dock may be measured instead of calculated, using any of various different technologies, such as a camera. In addition, the controller used for the system may be any of various controllers typically found in a boat, such as a smartphone, plotter, GPS, tablet, etc.

When planning a boat trip, a planner takes into account various factors such as, for example, weather, mileage for calculating time, provisions, possibly fuel, etc. Additional considerations may also include the physical aspects of docking facilities at locations where stops are planned.

What is clearly needed is a system and method with more information and capabilities for trip-planning than are currently available, one that includes the heights and types (fixed, floating) of docks and the tide ranges at proposed stops on the trip itinerary, thus providing a better experience when arriving at a docking location. Such a system would enable users to pre calculate and deploy the fenders immediately prior to arrival, thus protecting the boat and crew to the maximum extent possible while maintaining full comfort.

In some cases, a system for planning boat trips may predetermine dock location, dock type (fixed or floating), and tide height at the expected arrival time at a certain place, and, accordingly, may calculate the required fender selection and deployment height and, just prior to docking, may deploy the selected fenders at the selected height. Further, upon any last-minute change, such as, for example, a user decision to moor at a different dock nearby, the system updates the information accordingly and changes the fender height to the new values, which values may be acquired over a network from a server or a cloud. In such cases, the system may request permission before taking action, and the user may then confirm, adjust, or override the proposed system actions. In addition, the system then may ask the user to confirm that the system should store said changes for future reference. Also, upon docking, the system may request additional information, an "exit interview," to learn more about the facility at which the boat just docked. Then the system may send new data back to its database, where the data is anonymized before being added to the data repository.

Figure 1:
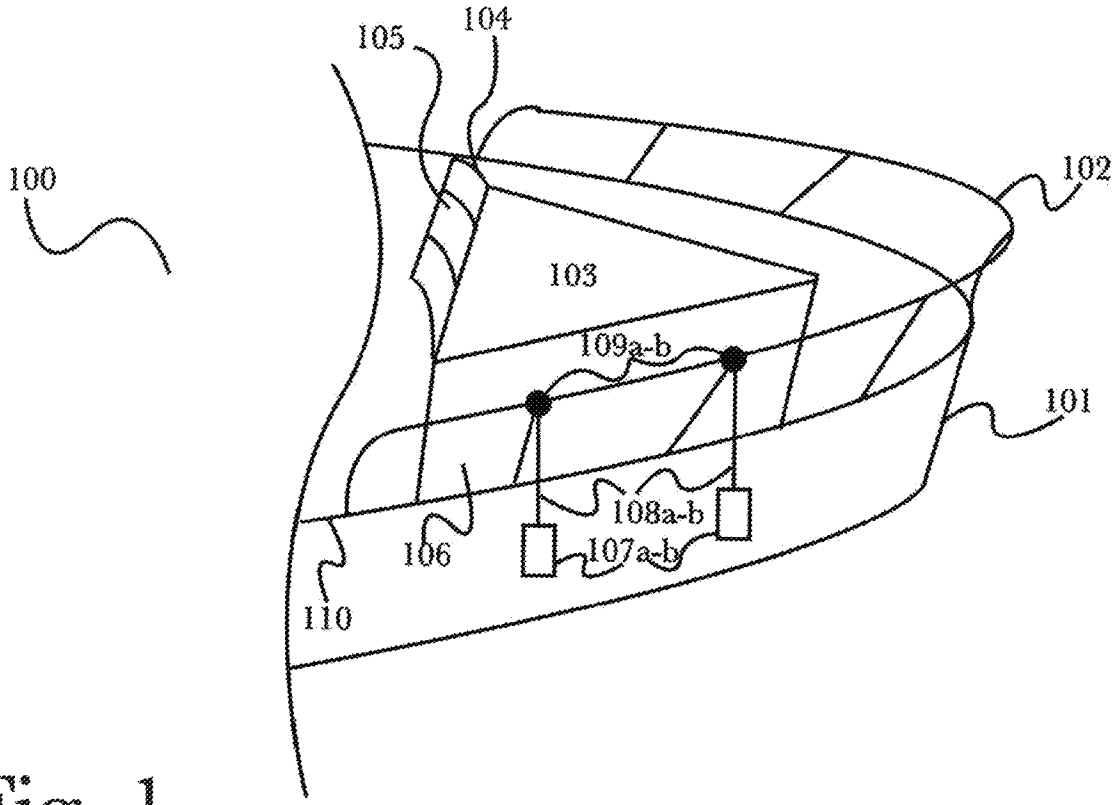
(Prior Art) Fig. 1
FIG. 1 (PRIOR ART) is an illustration of a typical pleasure boat, illustrating how fenders are normally hung on a boat's railings.

FIG. 1 (PRIOR ART) is an illustration of a typical pleasure boat 100, illustrating how fenders are normally hung on a boat's railings according to the prior art. Two fenders 107*a* and 107*b* hang down from the railing, positioned with lines 108*a-b* held in place with knots 109*a-b* on railing 102 to protect the boat from damage when the boat makes contact with the dock. During a cruise, the fenders need to be lifted up and securely stowed, as otherwise the wave action could easily rip them off or cause them to damage the boat. Access to the railing for purposes of deploying and positioning fenders from the top of the boat may be difficult and hazardous (particularly in rough seas or inclement weather), because in many cases access is available only from a narrow ledge 106 via a step 110 or from the top of the boat prow 103 using window gate 105 in windshield 104, that window gate being heavy and difficult to open. Boat prow 103 is often of a slick material such as fiberglass coated, in some cases, with marine paint. Further, the surface may in many cases be wet with, in some cases, dust mixed in, and/or the boat may be rocking and jerking in wind and waves, making it even more slippery and more hazardous. From the railing a person must then lean over to deploy and position the fenders.

Figure 2:
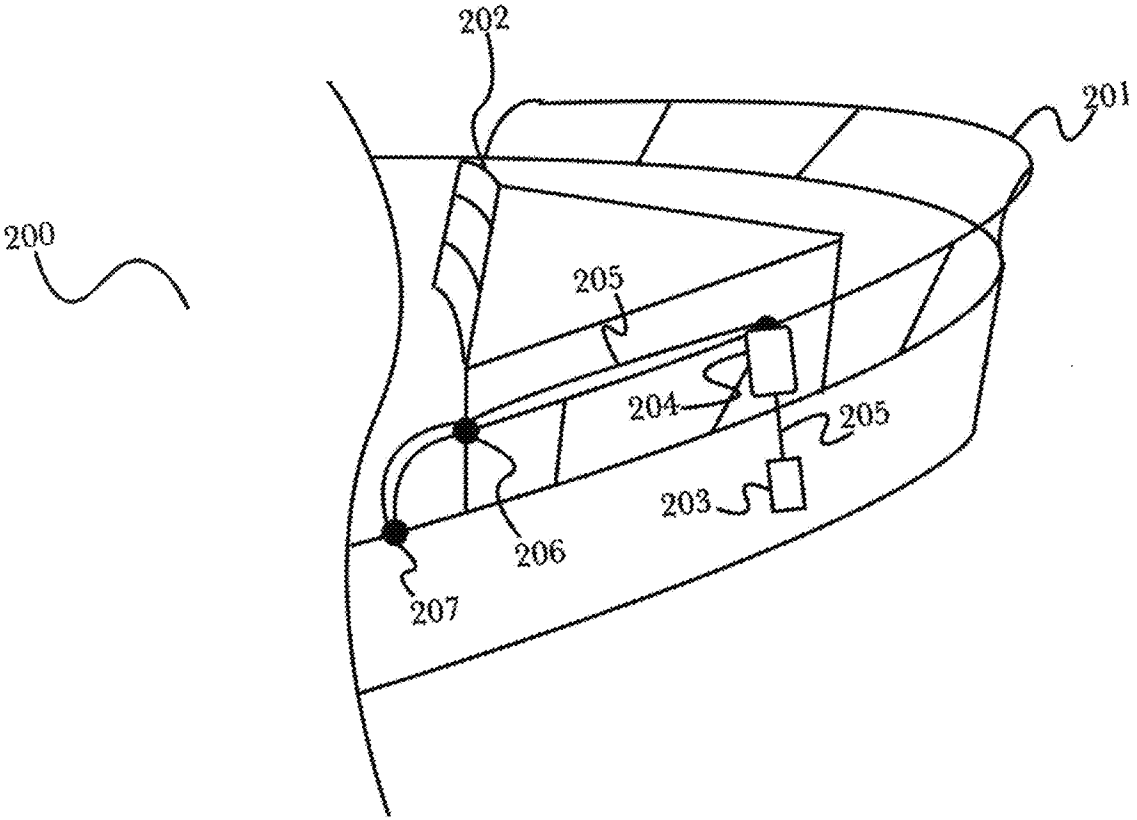
FIG. 2 shows an exemplary representation of an installation of manually-deployed boat fenders, according to a preferred embodiment of the invention.

FIG. 2 shows an exemplary representation of a system 200 of manually deployed boat fenders, with stowage baskets 204, according to a preferred embodiment of the invention. Windshield 202 has a center partition that can be folded away to reach the boat prow. Attached to railing 201 is fender basket 204, which holds fender 203 when the fender 203 is not in use (only one fender 203 and basket 204 are shown, for purposes of clarity and simplicity; however, typically, multiple fenders are used). A rope, cable, or similar flexible line 205 (for purposes of this system, rope, cable, and line all shall be considered equivalent, irrespective of constituent material(s)), runs from a position above basket 204, across pulley 206, to cleat 207, which cleat 207 is used by an operator to secure line 205 in position, which position is often predetermined and marked on line 205. Thus fender 203 may be hauled up into basket 204 when the boat is undocked and taken out on the water, and fender 203 may be deployed (lowered) when the boat approaches a dock.

Figure 3:
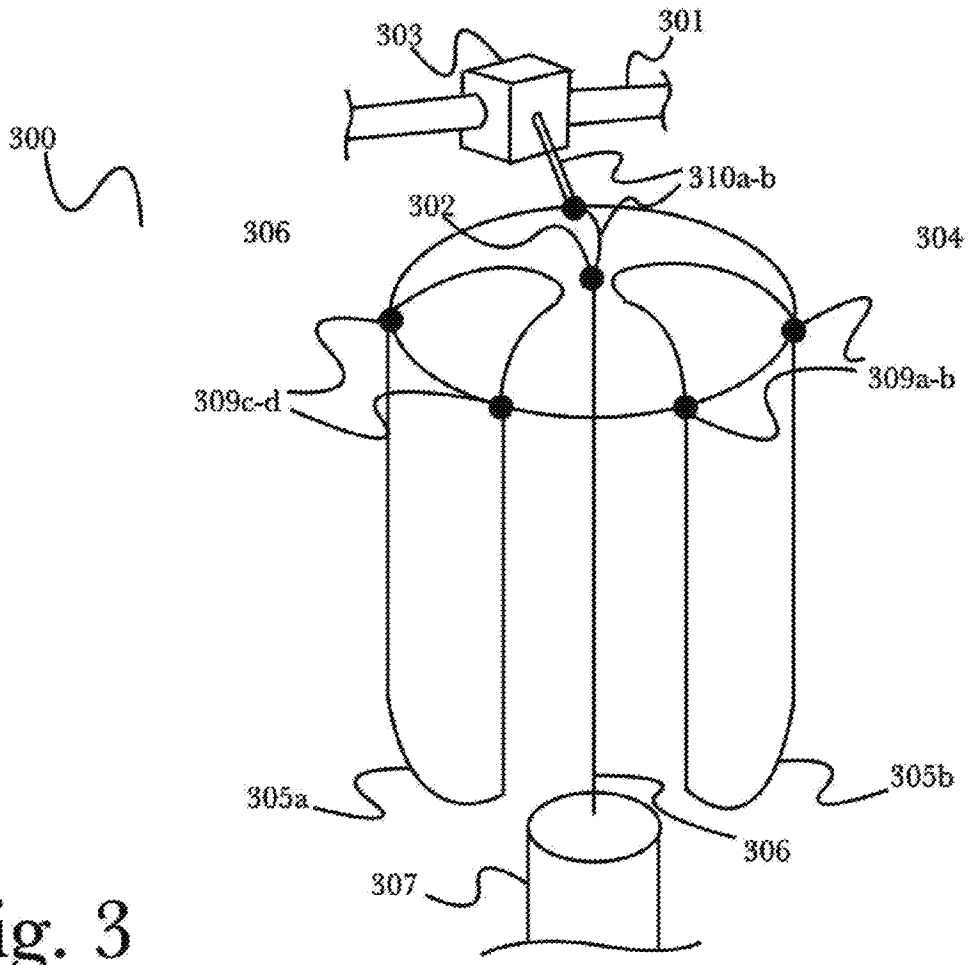
FIG. 3 shows an exemplary representation of a fender stowage basket according to a preferred embodiment of the invention.

FIG. 3 shows a detailed view of exemplary assembly 300 of basket 204 from FIG. 2 above, according to one aspect of the system and method disclosed herein. Attached by clamp 303 to railing 301 is a holder 310*a* that holds ring 304, which in turn holds the basket, plus a pulley (or ring) 302, via holder 310*b*, said pulley that is used to redirect line 306 when it comes up. In this example two sections (or segments) 305*a-b* are hinged at the top with, respectively, hinges 309*c-d* and 309*a-b*. The hinges are attached to ring 304. When fender 307 is pulled up on line 306 across pulley 302, the tips of hooks cause the extensions at the bottoms of sections 305*a-b* to clamp the fender in place, as the hinge lever action causes the bottom ends of sections 305*a-b* to pull in. In some cases, basket extension 305*a-b* may be made of plastic; in other cases, they may be made of some suitable material resistant to corrosion, such as, for example, chrome-plated wire. In yet other cases, the bottom end maybe be flaring, as shown in 305*a*, allowing for an easier insertion of the fender 307, in other cases it may be hooked inward, as shown in 305*b*, providing additional securing of fender 307 when stowed. Also, in additional cases, rather than two sections, three, four or more sections maybe used.

Figure 4:
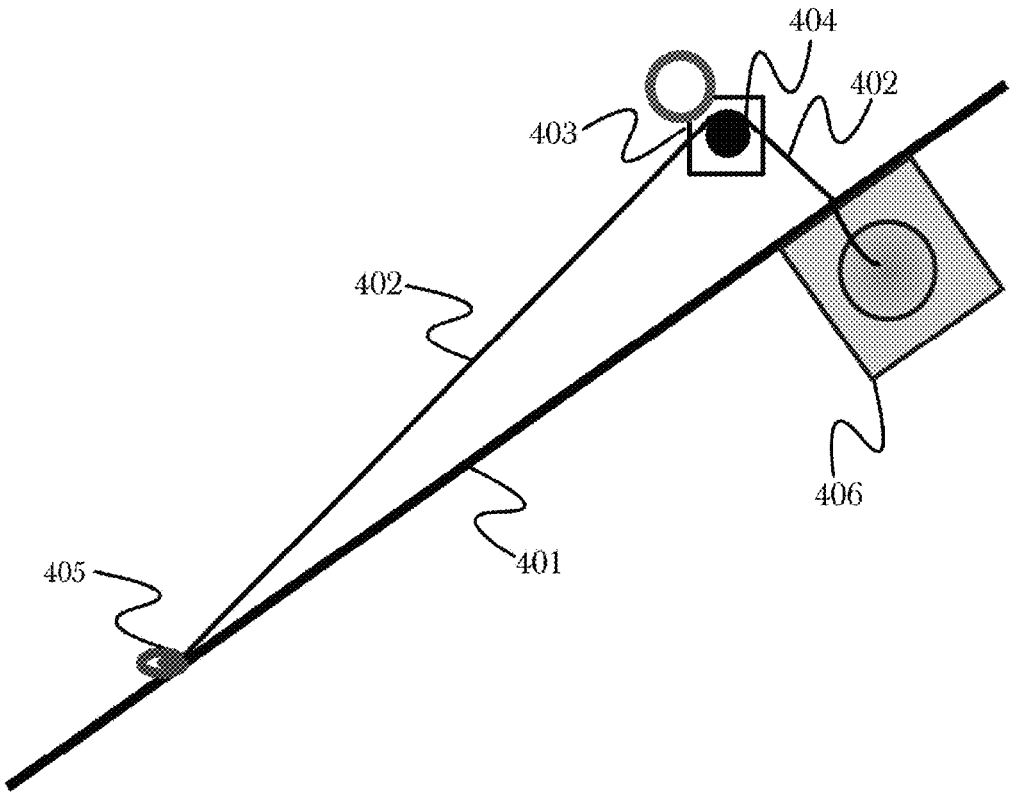
FIG. 4 shows an exemplary representation of a pulley and remote cleat mechanism for the safe and convenient stowage and deployment of boat fenders according to a preferred embodiment of the invention.

FIG. 4 shows an exemplary representation of a pulley and remote cleat mechanism 400 for the safe and convenient stowage and deployment of boat fenders 400 according to a preferred embodiment of the invention. Line 402 comes in from the basket 406 on railing 401 and goes through pulley wheel 404, which is attached to pulley block 403. At the pulley, line 402 is redirected to cleat 405. In some cases, double or triple pulleys maybe used as often more than one fender is used. Also, instead of regular cleats, fast cleats and multi-line fast cleats maybe used for easier use.

Figure 5:
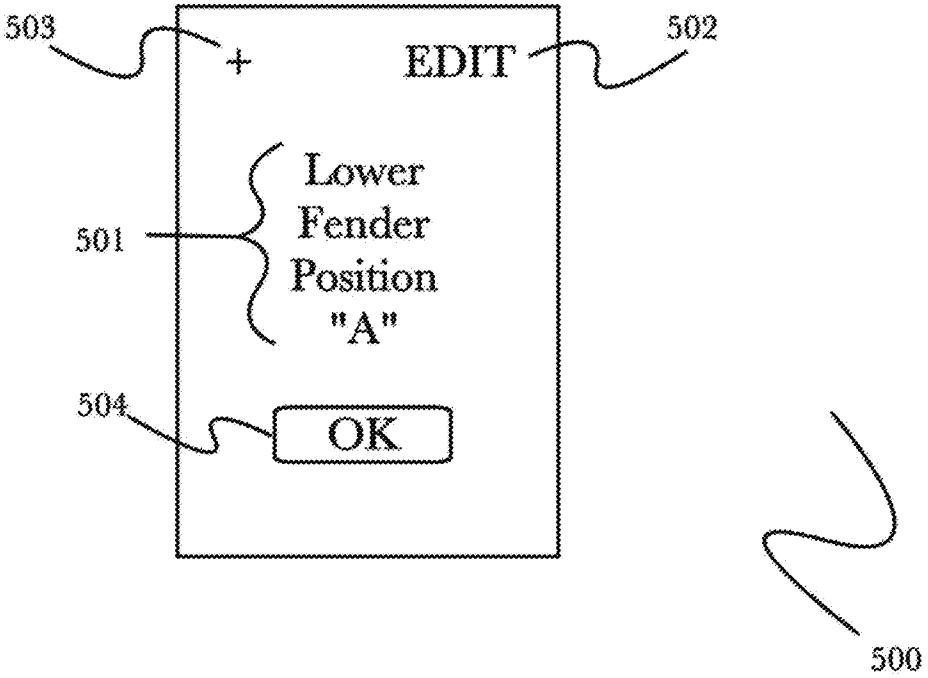
FIG. 5 shows an exemplary representation of a user reminder app for boat fender deployment according to a preferred embodiment of the invention.

FIG. 5 shows a popup screen of reminder app 500. It uses high-accuracy marine maps such as, for example those provided by NAVIONICS™, to determine whether the boat is about to dock, and notifies the user with message 501 (and in some cases an acoustic alert) of the position to which the lines need to be lowered. Also shown are buttons to add new positions "+" 503 based on current GPS location, to set the height, and to "edit" 502 for modifying an existing height, for example, or delete a previously stored location. Further, an OK button 504 enables the operator to confirm and/or close the alert and mute an acoustic signal.

FIG. 6 shows an exemplary representation of a system 600 where the connection of four basket and fender mechanisms connected by wires to a solar panel 604 according to a preferred embodiment of the invention. Four baskets 602*a-d* are attached to railing 601. Wires 605*a-d* connect the baskets to solar panel 604, which is also attached to railing 601. Beneath solar panel 604, and connected to it, are a controller and a battery (not shown here). Fender 603*d* (only one fender shown here, for clarity and simplicity) is shown as it may be deployed, with multiple dotted lines to indicate that the fender may be deployed at any of multiple heights. It is clear that a boat may carry more than four basket-fender units, and they are typically deployed all along an engaged side of the boat, from prow to stern; however, for clarity and simplicity, only four are shown as positioned here.

FIG. 7 is a diagram of a system 700 with a solar panel assembly connected to a basket and fender mechanism (as shown in 604) according to a preferred embodiment of the invention. Panel 701 connects to charge control unit 702. Unit 702 is an existing commercial product that is readily available. Often unit 702 may be integrated into a junction box at the rear of panel 701. Battery 703 may be any of various types of battery known in the art, such as, for example, lead-acid, lead-acid gel, lithium, lithium ion, LiFePO4, NiCd, NiMh, or any other suitable type, depending on which is best and most suitable for its situation. System controller 704 has an antenna 714 and wires 705*a-n* leading to the baskets. Exemplary basket 706, connected to box 704 via wire 705*x*, contains fender 713, shown in a dotted line to indicate that it is not externally visible. Line 712 goes over two pulleys 710*a, b* to winch 709 that is attached to motor 708. Casing 707 protects assembly elements, including 707, 709, 710*a,b*, 711, and 712 against water, collision, injury of persons nearby, etc. When fender 713 is retracted, switch 711 signals to controller 704 when the fender is fully retracted. In some cases, a smaller solar cell and smaller controller may be mounted on the top of the basket, omitting the need for wires such as wire 705*x*. Typically wire 705*x* uses a four-lead wire, that is, two for the motor and two for the switch. In other cases, instead of using a solar panel to power the system, controller 704 may be powered from the boat's power supply. In yet other cases, the assembly contained in case 707 may be installed centrally and the line may be pulled as shown in FIG. 2 to a location with multiple motorized winches. Also, in lieu of using a mechanical switch 711, optical means, both transmissive and reflective, may be used, or simply a change in current of the motor that the controller can detect and use as an indicator of too much resistance, either at the end or if fender is caught somehow. All these exemplary variations, and other, similar variations, shall not depart from the spirit of the system and method disclosed herein.

FIG. 8 is a diagram of an exemplary controller for the deployment and retraction of fenders 800, also shown in 704, according to a preferred embodiment of the invention. Power supply input 802 may come from a local battery, a shipboard battery, or some other power source. Controller 801 has a microprocessor 806, typically a system on a chip with memory 807 and nonvolatile memory 808, which nonvolatile memory contains software 809*a-n*, including an operating system as well as actual commands for the system. Input/output unit 810 may pair the radio 811 with a smart phone. Radio 811 connects to microcontroller 806 as well as to antenna 812. The connection between radio 811 and a smart phone may be via, for example, Bluetooth, Wi-Fi, or both, as needed. Power switch unit 803 distributes power to all these devices, as well as controlling output power through switches 804*a-n*, thus enabling the winches to extend lines to extend or retract the fenders. Switch unit 803 also has the input sensors for the switches in the baskets, such as, for example, switch 711 inside casing 707, described above in the discussion of FIG. 7, for extending or retracting the fenders.

FIG. 9 shows an exemplary overview of a computer system 900 as may be used in the system and method disclosed herein. It is exemplary of any computer that may execute code to process data. Various modifications and changes may be made to computer system 900 without departing from the broader spirit and scope of the system and method disclosed herein. CPU 901 is connected to bus 902, to which bus is also connected memory 903, nonvolatile memory 904, display 907, I/O unit 908, and network interface card (NIC) 916. I/O unit 908 may, typically, be connected to keyboard 909, pointing device 910, hard disk 912, and real-time clock 911. NIC 916 connects to network 914, which may be the Internet or a local network, which local network may or may not have connections to the Internet. Also shown as part of system 900 is power supply unit 905 connected, in this example, to ac supply 906. Not shown are batteries that could be present, and many other devices and modifications that are well known but are not applicable to the specific novel functions of the current system and method disclosed herein. Also present, but not shown in detail, as part of I/O unit 908, for example, with local wireless connections, such as BLUETOOTH™, WiFi, ZIGBEE™ etc. Further, in many cases, a GPS receiver is used to provide for location services.

FIG. 10 is an exemplary diagram of a wireless control system 1000 for deployment and retraction of boat fenders, according to a preferred embodiment of the invention. Controller 1001, which is functionally equivalent to controller 704, described above in the discussion of FIG. 7, has an antenna 1002 and also the software and other components required to control fender deployment operations as previously described. Controller 1001 may connect to a dedicated control unit 1003, which unit may have a set of buttons 1004*a-n*, such as, for example, two rows of buttons 1004*a-n* as shown here. Each button has a separate assigned function, such as controlling the raising or lowering of one or more fenders. General controls 1005*a-n* may, for example, indicate the status of certain system functions, such as, for example, power state and the state of connectivity to wireless network 1006, which network may use Bluetooth, Wi-Fi, or some other similar connection protocol. Controls 1005*a-n* may also control functions such as raising or lowering all fenders or certain combinations of fenders, such as all fenders on one side, for example. As an alternative control unit, system 1000 may use a smart phone, such as, for example, phone 1010, on whose touch screen 1013 the user can control the functions of specialized software 1011*a-n*. Software 1011*a-n* is specific to system 1000 and typically may be downloaded from an app store supplying software for the particular model of phone 1010. Software 1011*a-n* can communicate with controller 1001 via connection 1012, which may be Bluetooth, Wi-Fi, or some other similar connection protocol. Connection 1014 enables phone 1010 to communicate with geo-positioning satellites 1015*a-n*, using any of various global positioning systems (GPS) supported by phone 1010 and available currently or in the future.

FIG. 11 shows a representation of an exemplary system application screen 1100 depicting a boat approaching a dock in a harbor according to a preferred embodiment of the invention. In this example, a boat 1103 is in water 1101, approaching dock 1104, which dock extends from land 1102. When boat 1103 comes within a certain predetermined distance from dock 1104, an indicator 1105 appears on application screen 1100. The boat's position, in this example, is determined by high-accuracy navigational mapping software (not shown here) as mentioned in the description of FIG. 5. Indicator 1105 enables a user to open addition application menus with additional functionality.

FIG. 12 shows an application screen 1200, accessed using indicator 1105 that is exemplary of additional application functionality according to a preferred embodiment of the invention. In this example, boat 1201, viewed from the top, approaches dock 1202. Screen 1200 shows all boat fenders 1204*a-n*, of which in this example there are eight. Those fenders on the side approaching dock 1202 may be indicated, for example, by halo buttons, that is, buttons showing a halo around the fender indicating a possible user interaction. Screen 1200 may also contain an additional button (not shown here) that enables a user to control multiple fenders, such as, for example, all fenders together, all fenders on the side of the boat approaching the dock, all front fenders, all rear fenders, etc.

FIG. 13 shows an exemplary application screen 1300 that may open when a user has deployed boat fenders as described in the discussion of FIG. 12, according to a preferred embodiment of the invention. Represented on screen 1300 is one side 1301 of the boat, with fenders 1302*a-n*. Above and below fenders 1302*a-n* are arrows 1303*a-n*, indicating fender movement up or down. Buttons 1304*a-n* give a user control of general functions, such as, for example, deploying all fenders to a default position or saving a manually controlled position as a new default position. Individual fender positions may be manually controlled by pressing any of arrows 1303*a-n* to adjust any one fender up or down as desired. When the fenders are all adjusted for a certain dock, the user could then save the fender positioning as a new default for this location, so the next time the user goes to approach this particular dock, the fenders can be deployed automatically to the saved positions when the boat comes within a certain predetermined distance from the dock.

FIG. 14 shows an exemplary representation of a boat prow 1400 where a basket 1402 is mounted on one or more hinges 1403, according to a preferred embodiment of the invention. This figure shows many structures found at the prow of the boat, including railing 1405, prow 1401 with cabin windows, and other features. Exemplary basket 1402 is, in this example, mounted behind railing 1405, with mounting hinges 1403*a, b* on the inside of railing 1405. Chute 1404 is attached to basket 1402, so the fender within basket 1402 may slide down against the boat side. Deploying and retracting the fender may be done manually, with, for example, a line, or by a motor. In some cases, chute 1404 may have a small lip, so the fender can easily be retracted back up into basket 1402. In other cases, chute 1404 may be recessed behind the farthest extension of the outward vertical curve of prow 1400, thus not protruding into the line of travel (up and down) of the fender.

FIG. 15 shows an exemplary cross section 1500 of a boat 1501 with a representative basket secured by mounting hinges and a chute that aids in deployment, according to a preferred embodiment of the invention. The outlines of boat 1501, prow section 1507 on top, walkway 1508 behind the railing, and the hull are all, for reasons of clarity and simplicity, very simplified. Basket 1502, secured by mounting hinges 1503*a, b*, and chute 1504 are slightly behind the outermost part of the hull of boat 1501, because fender 1505 is heavy enough to slip over the edge of boat 1501 when it is deployed. Deploying and retracting fender 1505 may be done manually, with, for example, a line, or by a motor. On the other hand, when fender 1505 is retracted, because there is no edge of chute 1504 protruding beyond the hull, fender 1505 can easily slip back up chute 1504 and into basket 1502. Outline 1506 shows an alternative basket 1502 position, wherein basket 1502 may be hinged around the railing so that during deployment and retraction of fender 1505, the basket bottom tilts slightly outward.

FIG. 16 shows a diagram of an alternative arrangement 1600 by which basket 1603 may be recessed, according to a preferred embodiment of the invention. Shown are walkway 1607, behind railing 1602, and prow 1601. Railing 1602 has a notch or bay 1606 in the inner edge so fender basket 1603 can retract in large part behind the outline of the railing. In this example, hinge 1604 enables basket 1603 in position 1603*a* to swing out into position 1603*b*. Arm 1605, shown in position 1605*a* retracted and in position 1605*b* extended, may be operated manually, with, for example, a lever or knob, a line, a spring or by a motor, and the like. Deploying and retracting the fender (not shown here) may also be done manually, with, for example, a line, or by a motor, as described earlier herein. Arm 1605, in extended position 1605*b*, pushes basket 1603 into position 1603*b*, so the fender can deploy vertically without hitting the deck or railing. In some cases, such a bay or notch 1606 may be flanked by one or two posts, enabling additional hinges to further control the swing of basket 1603 (not shown). Once the fender is deployed, arm 1605 may retract basket 1603 to a position behind the boat's outline.

FIG. 17 shows an exemplary representation of an enhanced arrangement 1700 of boat fender basket 1701 according to a preferred embodiment of the invention. Basket 1701 has a mechanism for winding up line 1710 to retract fender 1711. The hinge allowing basket 1701 to swing in behind the hull line is comprised of springs 1702*a* and 1702*b*. These springs move basket 1701 outside the hull line for normal operations. Although this example shows two springs 1702, it is clear that other arrangements may have more or fewer springs 1702. These springs (1702*a-n*) hinge between bar 1703, which attaches typically to a vertical railing post or other suitable fixed object(s) on the boat, and basket rail 1704 (part of the basket structure 1700). Moveable bar 1705 has three openings. These openings 1708*a* and 1708*b* are at each end, for riding up and down basket bars 1707 and 1706, as well as one opening 1709, which is roughly in the center, for guiding line 1710 to which fender 1711 is attached. In the fully extended position, moveable bar 1705 is stopped at the bottom end of the basket, across the basket opening. As the fender 1711 is retracted, it catches moveable bar 1705 when it reaches opening 1709 and pushes bar 1705 up as fender 1711 is fully retracted, bar 1705 being moveable along the cylindrical axis of basket 1701. Optionally the boat name 1712, in alphanumeric characters, may be applied in desired color(s) and finishes. In some cases, basket 1701 may contain a camera (not shown) that provides a close-up view of the pier to the controlling tablet and or smartphone, helping to "fine-maneuver" the boat into the desired docking position.

FIG. 18 shows an exemplary fender deployment reminder pop-up screen 1800 according to a preferred embodiment of the invention. When approaching a marked location, such as a previously visited landing place. In this example as boat 1802 enters marina 1801, the question of whether to deploy or not, if no prior default was set, appears at the top of screen 1800. The user can then issue the command by clicking either one of the response buttons 1803*a-n*. Although this example shows two buttons 1803, there could be more, such as, for example, more than one deploy button, one for the standard height, and one or more for other options.

FIG. 19 shows a screenshot 1900 in which the system prompts the user whether to remember a decision regarding fender deployment. Specifically, the system prompts the user whether to remember the decision from screen 1800 for the next time the vessel approaches the same location, by selecting either one of the response buttons 1901*a-b*.

FIG. 20 shows a modified version of FIG. 7, according to one aspect of the system and method described herein. Added to controller 704 are two optional extensions. In configuration 2001*a* measuring resistor 2002 has been inserted in series with motor 708. Sensing amplifier 2003 delivers a sensing voltage to point C. Once a certain current has been exceeded, the sensing voltage triggers a motor shut-off by notifying the shutoff circuitry in the controller, typically in a way similar to the way shutoff switch 711 is notified. This approach can sense if the motor is over-loaded and can protect the batteries, the motor, and the driving transistors or relays. It can also be used to shut off the motor in the case of an entanglement, such as, for example, a tangle in the line or rope that pulls up the fender, or if the fender is somehow tangled below the basket and cannot be pulled up. Of course, it will be appreciated by one having ordinary skill in the art that other problems may occur that prevent a fender from being fully retracted; for example, due to boat motion caused by water waves, a fender may fail to properly enter the basket because of misalignment or rotation of the fender. Thus this approach can protect the line from being torn and the fender lost at sea. Alternative configuration 2001*e*, shows, instead of an added resistor 2002, that the switching transistor 2004 driving motor 708 between contact points F and G is used as the measuring resistor, and the amplifier 2005 drives the voltage H. Also, point I drives the transistor. Both configurations 2001*a* and 2001*e* are commonly used approaches to measuring currents or protecting motors and/or other circuitry elements from overload and are not novel in and of themselves. However, the use of motor overloads to detect entanglement with respect to the fender, and in particular to aid with untangling, is novel.

FIG. 21 shows a modified version of FIG. 17, according to one aspect of the system and method described herein. In approach 2100, camera 2101 is attached by stick 2102. Wire 2103 connects to controller box 1701, enabling transmission of images from the camera to show when the fender is lowered. When there is a problem raising the fender, camera view field 2104 can observe the state of the fender, such as, for example, if the fender is stuck on the sea bottom, if the fender line is tangled, etc. It is clear that wire 2103 could be run within stick 2012, or the camera could be placed in a bulge out of the top of controller 1701, etc. Various different cameras and viewing angles may be used to provide the best views of a problem. It is not necessary in all cases that the camera explicitly observes a tangle. It can be used, for example, simply to see whether the protection circuitry described above in the discussion of FIG. 20 has stopped the motor due to difficulty in raising the fender. In some cases, visual recognition software may be embedded in the camera module or in the central controller, so the system can identify either a tangle or a lack of motion of the fender, which, when the motor should be in motion, indicates highly likely a tangle or similar problem.

FIG. 22 shows an exemplary process 2200 for resolving problems with raising the fender, employing the two novel approaches disclosed above in the discussions of FIGS. 20 and 21, according to one aspect of the system and method disclosed herein. In step 2201, the system receives a command to pull up the fender. In step 2202, the system sets a maximum time to attempt to pull up the fender, and in step 2203, the system monitors the time to determine when the current attempt exceeds the preset maximum time. If, in step 2204, the system determines that the current attempt has exceeded the preset maximum time, in step 2205 the system checks to see if an End switch, such as, for example, switch 711 described in the discussion of FIG. 7, is activated, signaling that the fender is fully retracted. The inventor envisions that various switching means may be used as an End switch 711 according to the invention; for example, conventional contact-based electrical switches, radio frequency identification (RFID) proximity switches, mechanical switches, magnetic switches, or any other similar means of detecting when a fender is fully retracted. Additionally, more than one end switch may be utilized in some arrangements, for example to increase reliability if the fender is retracted at an angle, or to provide redundancy should any single switch fail (for example, due to damage to the receptacle). If the End switch is activated, indicating that the fender or movable bar is fully retracted, in step 2206 the process ends. However, in step 2205, if the system detects that the End switch is not activated, in step 2207 the system initiates a check for a tangle in the fender line. In step 2210, the system checks to determine the number of tangle checks, such as, for example, the first occurrence of a tangle check, or any number up to a preset maximum. Typically, only one or two attempts to detangle would occur, to avoid damage to the equipment. If, in step 2210 the detangle attempts do not exceed the preset limit, in step 2211 the system attempts to detangle the line, typically by a little tug or pull on the line, as would be done manually. After each detangle attempt in step 2211, the system returns to step 2202 to repeat the process. If the maximum current is not exceeded in step 2204, then in step 2208 the system again checks to see if the maximum time or number of attempts has been exceeded. If the detangle attempts fail repeatedly, in step 2209 the system attempts a visual check of the fender, using the camera as described in the discussion of FIG. 21. When the visual check is finished, the system once again attempts a detangle. If all system detangle attempts fail, the system issues a call for operator help in step 2212, and in step 2213 the process ends. Different strategies for detangling may be used, for example resulting in controlled jerking of the line and or the fender in order to resolve the tangle or jam. There may also time limits for individual sets of detangling and overall attempts in order to protect the components of the system from overload/damage. Further, failure to complete retraction may result in an alert sent to an operator or other predetermined location or person.

In some cases, in a system with a basket and a mechanism for stowing a boat fender, upon retracting the fender, the system shuts off the motor if an over-current arises due to a tangle in the line or a catch of the fender below the basket. Upon such a shutdown of the motor, the system engages in a limited number of small reversals in an attempt to detangle the line and/or the fender and achieve a full retraction. Additionally, a camera and visual recognition software may be used to detect a tangle or other problem with the line or the fender, in addition to the current sensing. Further, upon attempting to retract the fender, the motor shuts off if a disturbance in the retraction motion is recognized by the visual recognition software due to a tangle in the line or a catch of the fender below the basket. In such cases, the system engages in a limited number of reversals to attempt to detangle the line and or the fender and achieve a full retraction. Moreover, the current control may be used to aid the detangling control of the reversal of the line motion in addition to the camera. Different strategies for detangling may be used. There may also time limits for individual sets of detangling and overall attempts in order to protect the components of the system from overload/damage. Further, failure to complete retraction may result in an alert sent to an operator or other predetermined location or person.

FIG. 23 shows exemplary embodiments of the invention adapted to provide heavy swell protection for boat fender system 2300. During the course of boat use, storms or other disturbances may occur that result in the production of heavy swells or waves. These swells can possess enough energy to damage the machinery of either manually operated or motor operated fender systems, particularly when sudden movement of a vessel causes substantial tension to be applied suddenly to any cable holding a fender in place, thereby placing large and sudden stresses on the machinery of fender systems. The effects of heavy swells may operate both while the fenders are retracted—where the confines of the basket can serve to exacerbate the strength of the swell—and while the boat is docked—where the swells can exert significant tugging pressure or the fender can get caught between the dock and hull of the boat moving independently of each other, again tugging at the fender with significant force. According to the embodiments shown in FIG. 23, mechanisms that use elastic members situated between a fender 2301 and a line 2302 act to mitigate these forces before damage occurs to the rest of the system. In a preferred embodiment, boat fender 2301 is attached to a spring 2303, and the other end of the spring attached to line 2302, which goes to the rest of the system. Spring 2303 acts as a buffer between fender 2301 and the rest of the system. While a spring is shown and described, one knowledgeable in the art will realize that other elastic members (such as, but not limited to, bungee cords or bungee cables) could be used for the purpose of swell mitigation. In a second preferred embodiment of the invention, fender 2304 is equipped with a detached top 2307 which can move freely from the rest of fender 2304. Detached top 2307 is attached to the rest of fender 2304 by a spring 2306 internal to fender 2304; spring 2306 has a point of attachment to fender 2304 at its lower end, in the interior of fender 2304. In times of heavy force upon fender 2304 by a swell, spring 2304 serves to buffer the forces by allowing the top of the fender to partially separate temporarily until the stress is relieved. Detached fender top 2307 is then attached to a line 2305 that goes to the rest of the system. Alternatively, an internal spring 2306 may be used without detached top 2307, in which case spring 2306 may be connected directly to line 2305. It should be clear that the examples depicted in these figures are relatively simple configurations practical to clearly show the functional aspects of the system; other structures and parts such as but not limited to protective encasements, retainers, correct mounting hardware, drains, and guides are not depicted. Relative lengths or sizes of the parts are not meant to be to scale for operation.

In some embodiments, the rate of raising fender 1711 may be slowed when fender 1711 approaches an intermediate position; that is, intermediate between a deployed position and a stowed position. In a preferred embodiment, as fender 1711 just begins to enter the basket (e.g., basket 1701), the rate of raising fender 1711 is reduced, to reduce the likelihood of fouling and to potentially reduce the impact resulting from any misalignment, fouling, or other problem. It will be recognized by one having ordinary skill in the art that various means of detecting when to change (e.g., reduce) the rate of raising of fender 1711 may be used according to the invention. For example, a time duration of raising may be used or, if a stepper motor is used, a count of the number of steps during the raising of fender 1711 may be used. Additionally, various switches, such as electromagnetic proximity switches of mechanical switches, may be placed so that they send a signal to the control system as fender 1711 passes, for example, the lower end of basket 1701 while being raised. In some embodiments, basket 1701 may be partially open, with a lower circumferential ring at its lowest opening, a partially closed cylindrical portion above this lower circumferential ring, and a fully closed upper portion. In such embodiments, lowering of the rate of raising of fender 1711 into basket 1701 would typically occur as the top of fender 1711 enters the lower ring of basket 1701. Other variations are clearly possible, according to the invention, as will be appreciated by one having ordinary skill in the art.

Referring now to FIG. 24, there is shown a block diagram depicting an exemplary computing device 10 suitable for implementing at least a portion of the features or functionalities disclosed herein. Computing device 10 may be, for example, any one of the computing machines listed in the previous paragraph, or indeed any other electronic device capable of executing software- or hardware-based instructions according to one or more programs stored in memory. Computing device 10 may be configured to communicate with a plurality of other computing devices, such as clients or servers, over communications networks such as a wide area network a metropolitan area network, a local area network, a wireless network, the Internet, or any other network, using known protocols for such communication, whether wireless or wired.

In one embodiment, computing device 10 includes one or more central processing units (CPU) 12, one or more interfaces 15, and one or more busses 14 (such as a peripheral component interconnect (PCI) bus). When acting under the control of appropriate software or firmware, CPU 12 may be responsible for implementing specific functions associated with the functions of a specifically configured computing device or machine. For example, in at least one embodiment, a computing device 10 may be configured or designed to function as a server system utilizing CPU 12, local memory 11 and/or remote memory 16, and interface(s) 15. In at least one embodiment, CPU 12 may be caused to perform one or more of the different types of functions and/or operations under the control of software modules or components, which for example, may include an operating system and any appropriate applications software, drivers, and the like.

CPU 12 may include one or more processors 13 such as, for example, a processor from one of the Intel, ARM, Qualcomm, and AMD families of microprocessors. In some embodiments, processors 13 may include specially designed hardware such as application-specific integrated circuits (ASICs), electrically erasable programmable read-only memories (EEPROMs), field-programmable gate arrays (FPGAs), and so forth, for controlling operations of computing device 10. In a specific embodiment, a local memory 11 (such as non-volatile random access memory (RAM) and/or read-only memory (ROM), including for example one or more levels of cached memory) may also form part of CPU 12. However, there are many different ways in which memory may be coupled to system 10. Memory 11 may be used for a variety of purposes such as, for example, caching and/or storing data, programming instructions, and the like. It should be further appreciated that CPU 12 may be one of a variety of system-on-a-chip (SOC) type hardware that may include additional hardware such as memory or graphics processing chips, such as a QUALCOMM SNAPDRAGON™ or SAMSUNG EXYNOS™ CPU as are becoming increasingly common in the art, such as for use in mobile devices or integrated devices.

As used herein, the term "processor" is not limited merely to those integrated circuits referred to in the art as a processor, a mobile processor, or a microprocessor, but broadly refers to a microcontroller, a microcomputer, a programmable logic controller, an application-specific integrated circuit, and any other programmable circuit.

In one embodiment, interfaces 15 are provided as network interface cards (NICs). Generally, NICs control the sending and receiving of data packets over a computer network; other types of interfaces 15 may for example support other peripherals used with computing device 10. Among the interfaces that may be provided are Ethernet interfaces, frame relay interfaces, cable interfaces, DSL interfaces, token ring interfaces, graphics interfaces, and the like. In addition, various types of interfaces may be provided such as, for example, universal serial bus (USB), Serial, Ethernet, FIREWIRE™, THUNDERBOLT™, PCI, parallel, radio frequency (RF), BLUETOOTH™, near-field communications (e.g., using near-field magnetics), 802.11 (Wi-Fi), frame relay, TCP/IP, ISDN, fast Ethernet interfaces, Gigabit Ethernet interfaces, Serial ATA (SATA) or external SATA (ESATA) interfaces, high-definition multimedia interface (HDMI), digital visual interface (DVI), analog or digital audio interfaces, asynchronous transfer mode (ATM) interfaces, high-speed serial interface (HSSI) interfaces, Point of Sale (POS) interfaces, fiber data distributed interfaces (FDDIs), and the like. Generally, such interfaces 15 may include physical ports appropriate for communication with appropriate media. In some cases, they may also include an independent processor (such as a dedicated audio or video processor, as is common in the art for high-fidelity A/V hardware interfaces) and, in some instances, volatile and/or non-volatile memory (e.g., RAM).

Although the system shown in FIG. 24 illustrates one specific architecture for a computing device 10 for implementing one or more of the inventions described herein, it is by no means the only device architecture on which at least a portion of the features and techniques described herein may be implemented. For example, architectures having one or any number of processors 13 may be used, and such processors 13 may be present in a single device or distributed among any number of devices. In one embodiment, a single processor 13 handles communications as well as routing computations, while in other embodiments a separate dedicated communications processor may be provided. In various embodiments, different types of features or functionalities may be implemented in a system according to the invention that includes a client device (such as a tablet device or smartphone running client software) and server systems (such as a server system described in more detail below).

Regardless of network device configuration, the system of the present invention may employ one or more memories or memory modules (such as, for example, remote memory block 16 and local memory 11) configured to store data, program instructions for the general-purpose network operations, or other information relating to the functionality of the embodiments described herein (or any combinations of the above). Program instructions may control execution of or comprise an operating system and/or one or more applications, for example. Memory 16 or memories 11, 16 may also be configured to store data structures, configuration data, encryption data, historical system operations information, or any other specific or generic non-program information described herein.

Because such information and program instructions may be employed to implement one or more systems or methods described herein, at least some network device embodiments may include nontransitory machine-readable storage media, which, for example, may be configured or designed to store program instructions, state information, and the like for performing various operations described herein. Examples of such nontransitory machine-readable storage media include, but are not limited to, magnetic media such as hard disks, floppy disks, and magnetic tape; optical media such as CD-ROM disks; magneto-optical media such as optical disks, and hardware devices that are specially configured to store and perform program instructions, such as read-only memory devices (ROM), flash memory (as is common in mobile devices and integrated systems), solid state drives (SSD) and "hybrid SSD" storage drives that may combine physical components of solid state and hard disk drives in a single hardware device (as are becoming increasingly common in the art with regard to personal computers), memristor memory, random access memory (RAM), and the like. It should be appreciated that such storage means may be integral and non-removable (such as RAM hardware modules that may be soldered onto a motherboard or otherwise integrated into an electronic device), or they may be removable such as swappable flash memory modules (such as "thumb drives" or other removable media designed for rapidly exchanging physical storage devices), "hot-swappable" hard disk drives or solid state drives, removable optical storage discs, or other such removable media, and that such integral and removable storage media may be utilized interchangeably. Examples of program instructions include both object code, such as may be produced by a compiler, machine code, such as may be produced by an assembler or a linker, byte code, such as may be generated by for example a JAVA™ compiler and may be executed using a Java virtual machine or equivalent, or files containing higher level code that may be executed by the computer using an interpreter (for example, scripts written in Python, Perl, Ruby, Groovy, or any other scripting language).

In some embodiments, systems according to the present invention may be implemented on a standalone computing system. Referring now to FIG. 25, there is shown a block diagram depicting a typical exemplary architecture of one or more embodiments or components thereof on a standalone computing system. Computing device 20 includes processors 21 that may run software that carry out one or more functions or applications of embodiments of the invention, such as for example a client application 24. Processors 21 may carry out computing instructions under control of an operating system 22 such as, for example, a version of MICROSOFT WINDOWS™ operating system, APPLE OSX™ or iOS™ operating systems, some variety of the Linux operating system, ANDROID™ operating system, or the like. In many cases, one or more shared services 23 may be operable in system 20, and may be useful for providing common services to client applications 24. Services 23 may for example be WINDOWS™ services, user-space common services in a Linux environment, or any other type of common service architecture used with operating system 21. Input devices 28 may be of any type suitable for receiving user input, including for example a keyboard, touchscreen, microphone (for example, for voice input), mouse, touchpad, trackball, or any combination thereof. Output devices 27 may be of any type suitable for providing output to one or more users, whether remote or local to system 20, and may include for example one or more screens for visual output, speakers, printers, or any combination thereof. Memory 25 may be random-access memory having any structure and architecture known in the art, for use by processors 21, for example to run software. Storage devices 26 may be any magnetic, optical, mechanical, memristor, or electrical storage device for storage of data in digital form (such as those described above, referring to FIG. 24). Examples of storage devices 26 include flash memory, magnetic hard drive, CD-ROM, and/or the like.

In some embodiments, systems of the present invention may be implemented on a distributed computing network, such as one having any number of clients and/or servers. Referring now to FIG. 26, there is shown a block diagram depicting an exemplary architecture 30 for implementing at least a portion of a system according to an embodiment of the invention on a distributed computing network. According to the embodiment, any number of clients 33 may be provided. Each client 33 may run software for implementing client-side portions of the present invention; clients may comprise a system 20 such as that illustrated in FIG. 25. In addition, any number of servers 32 may be provided for handling requests received from one or more clients 33. Clients 33 and servers 32 may communicate with one another via one or more electronic networks 31, which may be in various embodiments any of the Internet, a wide area network, a mobile telephony network (such as CDMA or GSM cellular networks), a wireless network (such as Wi-Fi, WiMAX, LTE, and so forth), or a local area network (or indeed any network topology known in the art; the invention does not prefer any one network topology over any other). Networks 31 may be implemented using any known network protocols, including for example wired and/or wireless protocols.

In addition, in some embodiments, servers 32 may call external services 37 when needed to obtain additional information, or to refer to additional data concerning a particular call. Communications with external services 37 may take place, for example, via one or more networks 31. In various embodiments, external services 37 may comprise web-enabled services or functionality related to or installed on the hardware device itself. For example, in an embodiment where client applications 24 are implemented on a smartphone or other electronic device, client applications 24 may obtain information stored in a server system 32 in the cloud or on an external service 37 deployed on one or more of a particular enterprise's or user's premises.

In some embodiments of the invention, clients 33 or servers 32 (or both) may make use of one or more specialized services or appliances that may be deployed locally or remotely across one or more networks 31. For example, one or more databases 34 may be used or referred to by one or more embodiments of the invention. It should be understood by one having ordinary skill in the art that databases 34 may be arranged in a wide variety of architectures and using a wide variety of data access and manipulation means. For example, in various embodiments one or more databases 34 may comprise a relational database system using a structured query language (SQL), while others may comprise an alternative data storage technology such as those referred to in the art as "NoSQL" or "Big Data" (for example, HADOOP CASSANDRA™, GOOGLE BIGTABLE™, MongoDB™, Apache Spark and so forth). In some embodiments, variant database architectures such as column-oriented databases, in-memory databases, clustered databases, distributed databases, or even flat file data repositories may be used according to the invention. It will be appreciated by one having ordinary skill in the art that any combination of known or future database technologies may be used as appropriate, unless a specific database technology or a specific arrangement of components is specified for a particular embodiment herein. Moreover, it should be appreciated that the term "database" as used herein may refer to a physical database machine, a cluster of machines acting as a single database system, or a logical database within an overall database management system. Unless a specific meaning is specified for a given use of the term "database", it should be construed to mean any of these senses of the word, all of which are understood as a plain meaning of the term "database" by those having ordinary skill in the art.

Similarly, most embodiments of the invention may make use of one or more security systems 36 and configuration systems 35. Security and configuration management are common information technology (IT) and web functions, and some amount of each are generally associated with any IT or web systems. It should be understood by one having ordinary skill in the art that any configuration or security subsystems known in the art now or in the future may be used in conjunction with embodiments of the invention without limitation, unless a specific security 36 or configuration system 35 or approach is specifically required by the description of any specific embodiment.

To prevent damage due to changes in water level when a boat is fastened to a vertically stationary dock, what is needed is a system wherein the fender may be vertically adjusted over time as the height of the boat changes with the water level.

In some areas, the change in water level due to the tide is small, in other areas the change is quite large. This change in water level is called the tidal range. In most areas the tidal range is 1 to 4 meters, but in some areas it can be more extreme, while in other areas is may be less. Typically, the range can be anywhere from half a meter to 11 meters; and in some very extreme cases, the tidal range may be as much as 17 meters, although such a range is considered an extreme outlier, as in Fundy Bay in Canada. Accordingly, the height of the fender needs to be adjusted based on the locally prevalent tidal range, but may not be able to serve extreme outliers. The greater the tidal range, the faster the vertical movement of the boat, and therefore, the fender height needs to be adjusted more quickly. Thus, at a dock where the tidal range is large, fender adjustment may need to occur every 5 minutes, or even as quickly as every minute. If the tidal range is small, fender adjustment as slowly as every 15 or even every 30 minutes may be sufficient to keep fender in a reasonable range. However, once the rub rail or rub edge of the boat, which is the most exposed edge of the boat, is lower than the edge of the pier, typically no further fender adjustment is needed to keep the boat safe, since the fender now remains at (just above or in some cases just below) the most exposed edge (rub rail) of the boat. In some cases, when large adjustments for tidal ranges are necessary, the chance for entanglements is accordingly greater and de-tanglement procedures as discussed above maybe deployed to counteract entanglements accordingly.

FIG. 27 shows an exemplary tidal range effect 2700 on docking levels, according to one aspect of the system and method disclosed herein. Scenarios a, b, and c show three different docking levels at fixed-height pier 2701. Tidal range may include water levels 2703*a*, 2703*b*, and 2703*c* or any level in between. Scenario a shows water level 2703*a* with resulting boat position 2702*a* resulting in optimal fender position 2706*a*. Scenario b shows water level 2703*b* with resulting boat position 2702*b* resulting in optimal fender position 2706*b*. Scenario c shows water level 2703*c* with resulting boat position 2702*c* resulting in optimal fender position 2706*c*. Scenario b and scenario c are nearly equivalent for boat 2702*b*, 2702*c* and fender 2706*b*, 2706*c* positions; with fender 2706*b*, 2706*c* between dock wall 2701 and rub rail 2705 of boat 2702*b*, 2702*c*. Once rub rail 2705 is lower than top of dock 2701, fender 2706*b*, 2706*c* remains between dock 2701 and boat 2702*b*, 2702*c* without further adjustment. Note that for clarity and simplicity, only boat deck 2704 and railing 2705 are shown and no other details of boat 2702*a*, 2702*b*, 2702*c* or surroundings (such as port buildings, boat cabin, shoreline, etc.) are shown.

FIG. 28 shows an exemplary process 2800 for calculating and initiating automatic vertical adjustment of a boat fender by software, according to one aspect of the system and method disclosed herein. In step 2801, the system obtains the boat's GPS location. Then, in step 2802, the system sends tide data 2802 for the current time and the location of the boat to database 2803 in cloud 2804. Typically, cloud 2804 may be connected to the Internet but in some cases it could be a private cloud, or in other cases data could be stored locally on a user's phone or some other type of computing device for example. In such cases, data may pertain solely to waters in which the boat typically travels, such as Northern California for example, if that is where the user typically goes boating. In other such cases, the user may download tide data in advance to a phone or other data storage device, as well as information for the area of a planned boat trip where the user may not have reliable access to remote data storage. All of these data storage and retrieval options are well known for various types of geographic and climate data and therefore are not shown in detail. In step 2805 the system retrieves tidal range information from database 2803. In step 2806 the system calculates, based on the tidal range motion, the energy needed to adjust the fenders during the trip. This step is important when batteries are used as a power source, because if numerous fenders must be moved frequently to accommodate a wide tidal range over an extended period of time, the total power drain may exceed the capacity of the battery system to support all this activity while still retaining a safe power reserve. In step 2807 the system displays the period of safe operation. This battery power calculation is an optional feature, the need for which depends on, among other things, whether the battery may be recharged from the boat motor. The power consumption information may be transmitted to the local boat or fender controller, so that if the user leaves the boat, for example, for an inland excursion, the system can operate independently of the user's phone, if that is where the information is stored. In other cases, an additional controller, such as a tablet or other computing device, may remain on board and control the system. In step 2808, a starting position for deployed fenders is confirmed. Once all the parameters have been calculated, in step 2809 the user is prompted to review and decides whether any further adjustments are needed. In some cases, for example, if the rub rail is below the edge of the dock, or below some other critical vertical position, at the time of docking, the user may be prompted to estimate how far below, so the system can calculate if and when to resume raising and lowering the fenders in the future. This may be the case when a user docks while the boat is in a situation like 2703*c* in FIG. 27 above, and the fenders will be in a static position for the foreseeable future. If no further adjustments are needed (step 2809 no), the system starts the software in step 2810 and loads it into the control unit(s) in step 2811. The process then terminates in step 2812. If the user decides that further adjustments are needed, (step 2809 yes), he may input new parameters, such as, for example, a different period of time for automatic fender movement, or a different number of fenders to move. The system then returns to step 2808 and continues until it can move to step 2810. Not shown are control procedures that execute in each fender control unit and continue until the user cancels or modifies the program. Such modifications may include manual override of the system, retracting or adjusting the fenders manually, loading a new program, etc.

In some cases, system may control vertical movement of boat fenders based on tidal range, derived for example including but not limited to from charts, tables, nautical maps, databases, navigational software, user experience data and or other accessible sources in any combination as available, loading software into fender controller to lift and lower fenders over a period of time as boat rises and falls with water levels when docked at a vertically stationary dock. In such cases, when rub rail of boat falls below level of top of dock, bottom of deck, or a predefined or calculated level of dock, fenders may no longer move vertically; and when edge of boat rises above top or bottom of dock, or any predefined or calculated level of dock from opposite side, fenders may resume moving to protect the part of boat that may contact dock. In addition, the system may optionally, calculate battery power required to move fenders over a given period of time and check battery charge to ensure it has sufficient power, and then report its findings to user. In further cases, fender location relative to dock may be measured instead of calculated, using any of various different technologies, including for example, a camera. In addition, controller used for system may be any of various controllers typically found in boat, such as a smartphone, plotter, GPS, tablet, etc.

FIG. 29 shows an exemplary map segment of a trip plan 2900, according to one aspect of the system and method disclosed herein. A set of points are plotted along coastline 2901, which, in this example, is similar to the coastline of the San Francisco Bay and the Pacific Ocean coast north and south of the bay. A user in a boat plans to stop at points 2902*a-h*, which points may be derived from any of various mapping software products, such as, for example, GOOGLE MAPS™, NAVONICS™, or other, similar products. At each travel point, the user wants to know in advance which fenders to deploy, and at what height, to accommodate to the dock at that point, taking into consideration whether the dock has a fixed or tidal-controlled height, on which side the boat will adjoin the dock, and any other such variable considerations, as discussed previously and throughout.

FIG. 30 shows a simplified overview of a system 3000 discussed throughout. System 3012 is in a boat, with multiple control units 3022*a-n*, each with deployed fenders 3023*a-n*. Control unit 3020, such as, for example, an iPad, contains several software instances 3012*a-n* and control units 3022*a-n*. In addition, in this case, mobile device 3010, such as a cellular phone or smart phone 3010, contains several software instances 3011*a-n* connecting through network 3005. Network 3005 may be, for example, a cellular network or the Internet or both, with connections to multiple servers and databases, illustrated here, for simplicity and clarity, as one server 3001 in the cloud and one server 3002 with its own database 3004 and applications 3003*a-n*.

All the various elements of FIG. 30 form a system together, and the functions described herein throughout may be distributed through all these applications and databases together. Thus each procedure may run on one or more of these elements and may be distributed throughout. Likewise, the data may be distributed on one or more places. Some data may be in the cloud, while other system data may be on a mobile device or on a device integrated into the boat, so it can be used when and where there may be no connectivity to any network.

FIG. 31 shows an exemplary process 3100 for implementation of a trip-planning system, according to one aspect of the system and method disclosed herein. Process 3100 typically would run, for example, on a smart phone such as device 3010 as one of applications 3011*a-n*. Alternatively, the process could run on iPad 3020, or on any other such device, and the resulting data could be transferred between various different devices, thus giving a user maximum flexibility of use. In step 3110, planning for the specific trip begins with establishing a trip identity, such as a name, date, or other unique identifier. In step 3111, travel point locations are loaded, typically from a cloud-based service such as, for example, database 3103 residing in cloud 3102. Cloud 3102 could be a private cloud, a public cloud, or any combination thereof, as described earlier in the discussion of FIG. 30, above. Then in step 3112 the user selects the first target location, such as, for example, target 2902*a*, as shown in FIG. 29. In step 3113, the user loads information about the desired fender deployment. This information may come from local database 3101, if the user has visited location 2902*a* previously and has stored such information. If the user does not have that data, stored locally, or if he wishes to augment his data, he can obtain generic data from database 3103, drawing on information from other boats, or from general information about tides, dock type (fixed or floating), currents, etc. If the user is familiar with this location and knows his preferred dock (in cases where the location offers a choice of docks from multiple docks), he may know whether the preferred dock is fixed or floating. When the user has obtained as much information as he can and as he desires, in step 3114 the user stores his selection, writing the data back into both local database 3101 and cloud-based database 3103. Data written into database 3103 may be provided, anonymously, to other users of this database. In some cases, the user may be offered the option to opt out of entering data into database 3103 or similar, or in yet other cases, the user may be offered the option of delaying transmission of the data, e.g. at the end of a race or regatta, or when free Wi-Fi is available etc. In some cases, if a user chooses to permanently opt out of sharing data, the system may not offer said user access to certain data or may require the user to pay a premium to obtain such data, etc. In step 3115, the system asks the user if he wants to add more location points to the trip. If yes, the process returns to step 3112 and the user selects another target location. If no, the process ends at step 3116.

FIG. 32 shows an exemplary process 3200 for anonymization and consolidation of fender data provided by multiple boat users, according to one aspect of the system and method disclosed herein. The system runs this process periodically as required to refresh and combine data as users contribute it. In step 3210 the system loads data from database 3202 in cloud 3201. In step 3211 the system sorts and reviews various data, looking for new or revised data, such as, for example, dock location and type, either floating or fixed. Available maps may show the boundary between land and water, but may not provide information about dock locations and types. In some cases, a large marina may have both fixed and floating docks. Thus the system may extract information about the location and type of docks from data provided by boaters and add it to the existing database. The system may also integrate information provided by boaters about localized tidal behavior. In some harbors, the coastal contours, currents, and other factors may cause highly localized variations in tidal heights. With information from multiple system users, the system may generate detailed maps of tidal variations in a location. In step 3212 the data is anonymized and processed, and in step 3213 new information is loaded back into database 3202 so it is available to all system users. In step 3214, the system checks to determine whether more information is available for processing. If yes, the process returns to step 3211; if no, the system moves to step 3215, where the process ends.

FIG. 33 is a method diagram showing an automated fender deployment system's behavior 3300 in response to arriving at a location that may be either known 3302 or unknown 3303, and reporting data to the servers about location 3301 and fender deployment adjustments based on user input 3304. If arriving at an unknown location 3302, method 3300 further comprises the step of adjusting fenders to user input and informing servers 3304. If arriving at a known location 3303, the method further comprises the step of automatically executing a server-directed fender deployment protocol 3303. This system creates a shared user experience database, for automation purposes that expand functionality, based on communal use. That is, where a first boater docks manually, others may follow automatically.

FIG. 34 shows a system 3400, comprising a server 3401 sending and receiving data 3403, via networking 3402 to network connected devices 3404 and 3405, in order to automate fender deployment apparatuses directly 3404 and 3405 even over local networking 3406. The data 3403 collected during boating and fender deployment and retrieval operations may be stored in database 3409 such that it can automate functions such as fender deployment based on the information it receives from GPS 3410.

The skilled person will be aware of a range of possible modifications of the various embodiments described above. Accordingly, the present invention is defined by the claims and their equivalents.

What is claimed is:

1. A system for planning boat fender deployment location, comprising:

a fender basket adapted to contain a boat fender in a stowed position to lower the boat fender from the stowed position into a deployed position capable of protecting a boat's hull;

wherein the boat fender is attached to a line, the line being coupled to a winch, the winch being coupled to a motor; and a boat fender controller comprising at least a processor, a memory, and a plurality of programmable instructions stored in the memory and operating on the processor, wherein the plurality of programmable instructions, when operating on the processor, cause the processor to:

receive location information pertaining to the boat;

determine when the boat approaches a predetermined dock location or mooring area; and, based on the determination, activate a motor attached to a winch, the winch being connected by a plurality of lines to a plurality of boat fenders, thereby lowering the plurality of boat fenders of the boat.

2. The system of claim 1, wherein the system calculates boat fender deployment location based on real-time information, the real-time information comprising boat location.

3. The system of claim 1, wherein the system adjusts the boat fender deployment height.

4. The system of claim 3, wherein the system adjusts the boat fender deployment height based on characteristics of the boat.

5. The system of claim 3, wherein the system adjusts boat fender deployment height based on the docking location.

6. The system of claim 2, wherein the system updates the calculated boat fender deployment height in response to a change in at least a portion of the real-time information.

7. The system of claim 3, wherein the system updates the calculated boat fender deployment height in response to a tidal information.

8. The system of claim 2, wherein at least a portion of the real-time information is received from a data source via a network.

9. The system of claim 1, wherein the boat fender controller operates a user interface, wherein the user interface is configured to prompt a user prior to raising or lowering the plurality of boat fenders.

10. The system of claim 9, wherein the user interface is configured to present a user with a plurality of prompts.

11. The system of claim 9, wherein at least a portion of the user interaction is stored for future use.

12. The system of claim 1, wherein the boat fender controller is embedded as a component within a smartphone, a navigation plotter, a GPS device, a tablet, an automatic boat fender system, the boat itself or any other equipment on the boat.

13. The system of claim 2, wherein at least a portion of the information is stored for future use.

14. The system of claim 1, wherein the programmable instructions further provide a planning application that:

allows a plurality of future docking sites or areas to be specified by a user.

15. The system of claim 1, wherein the programmable instructions further provide a planning application that:

allows a plurality of future docking sites or areas to be specified by a user;

determines a planned boat fender deployment height for each specified docking site and time.

16. The system of claim 14, wherein the planning application also adjusts, using real-time actual arrival times and tidal data, the planned boat fender deployment height for a docking location, prior to arrival of a boat at a docking location.

17. The system of claim 14, wherein the boat fender controller, using the adjusted planned boat fender deployment height, automatically deploys a boat fender as the boat arrives at a first docking location of the plurality of docking locations.

18. The system of claim 3, wherein actual boat fender deployment heights data for a specific docking event are stored on a server for use by other system users.

19. The system of claim 18, wherein at least some of the planned boat fender deployment heights are determined using historical data retrieved from the server.

20. The system of claim 1, wherein the system is a component of a navigation system.

* * * * *